US005659152A

United States Patent [19]

Horie et al.

[11] Patent Number: 5,659,152

[45] Date of Patent: Aug. 19, 1997

[54] COMMUNICATION CABLE

[75] Inventors: Yasushi Horie; Kazuo Chiba; Kunio Negishi, all of Tokyo, Japan

[73] Assignee: The Furukawa Electric Co., Ltd., Tokyo, Japan

[21] Appl. No.: 401,477

[22] Filed: Mar. 9, 1995

[30] Foreign Application Priority Data

Mar. 14, 1994 [JP] Japan ..... 6-068181

[51] Int. Cl.[6] ..... H01B 11/04

[52] U.S. Cl. ..... 174/113 R; 174/36; 174/128.2

[58] Field of Search ..... 174/113 R, 128.1, 174/27, 128.2, 126.2

[56] References Cited

U.S. PATENT DOCUMENTS

| | | | |
|---|---|---|---|
| 3,546,357 | 12/1970 | MacPherson et al. | 174/34 |
| 3,879,518 | 4/1975 | Ney et al. | 264/174 X |
| 3,978,275 | 8/1976 | Ishihara et al. | 174/34 X |
| 4,604,862 | 8/1986 | McGettigan et al. | 57/264 X |
| 5,424,491 | 6/1995 | Walling et al. | 174/113 R |

OTHER PUBLICATIONS

EIA/TIA (Electronic Industries Association/Telecommunications Industry Association) Standards Proposal No. 2840 (Commercial Building Telecommunications Cabling Standard), Washington, D.C., USA, 1993.

ISO/IEC Joint Technical Committee 1, Draft Minutes of the 14 meeting of WG3 at Lannion, France, 1993.

*Primary Examiner*—Kristine L. Kincaid
*Assistant Examiner*—Chau N. Nguyen
*Attorney, Agent, or Firm*—Frishauf, Holtz, Goodman, Langer & Chick

[57] ABSTRACT

A communication cable formed by cabling units such that each two adjacent units have different twist pitches, each unit including insulated wire pairs twisted together. A twist pitch $P_i$ of insulated wire pair $T_i$ selected among insulated wire pairs constituting a unit $U_i$, and a twist pitch $P_j$ of insulated wire pair $T_j$ selected among insulated wire pairs constituting a unit $U_j$, are different. Twist pitches $P_i$ and $P_j$ are selected from a region which satisfies expression (1) and either (2) or (3). Twist pitch $P_i$ and twist pitch $P_k$ of insulated wire pair $T_k$ selected among insulated wire pairs constituting a unit $U_k$, are selected from a region which satisfies expression (4) where twist pitches $P_i$ and $P_k$ are in compliance with prior conditions given by (4). In the following expressions, x represents a unit diametrical component, y represents a unit lengthwise component and d is the outside diameter of insulated wires which constitute the insulated wire pairs.

$$P_{ix} \times P_{jx}/d^2 \leqq 7; \quad \ldots (1)$$

one of: $P_{iy}/P_{jy} \geqq 1.25$ ($P_{iy} > P_{jy}$), and $$P_{iy}/P_{jy} \leqq 0.8 \ (P_{iy} < P_{jy}), \text{ where } 144 \leqq P_{iy} \times P_{jy}/d^2 \leqq 413; \quad \ldots (2)$$

one of: $P_{iy}/P_{jy} \geqq 1.09$ ($P_{iy} > P_{jy}$), and $$P_{iy}/P_{jy} \leqq 0.92 \ (P_{iy} < P_{jy}), \text{ where } P_{iy} \times P_{jy}/d^2 \leqq 144; \quad \ldots (3)$$

one of: $P_{iy}/P_{ky} \geqq 104$ \($P_{iy} > P_{ky}$), and $$P_{iy}/P_{ky} \leqq 0.96 \ (P_{iy} < P_{ky}), \text{ where } P_{iy}/d > 16.4 \text{ and } P_{ky}/d > 16.4 \quad \ldots (4)$$

8 Claims, 15 Drawing Sheets

COMMUNICATION CABLE

BACKGROUND OF THE INVENTION

1. Field of the Invention

The present invention relates to a communication cable used for high-speed data communication and the like, and more particularly to an improvement of a communication cable having a plurality of insulated wire pairs.

2. Description of the Related Art

Some communication cables are used in restricted areas such as office and commercial buildings. In general, the communication cables of this type include indoor or private cables, which are adapted mainly for the transmission of aural signals, and cables for computer networks (LAN) of speed up to 20 Mbps which are formed by twisting a plurality of insulated wire pairs together. Conventionally, the so-called crosstalk characteristic of these communication cables is improved by twisting each two adjacent insulated Wire pairs with different twist pitches or by arranging the wire pairs lest the twist pitch of one wire pair be an integral multiple of that of another, so that the crosstalk is reduced.

Recently, there has been an increasing demand for high-speed data communication of 100 Mbps or thereabout in private wiring systems for use in office and commercial buildings. For these communication cables for high-speed data communication, standard specifications are provided by the EIA/TIA568A (Electronic Industries Association/Telecommunications Industry Association, hereinafter referred to as "EIA/TIA"). For those electric wires which can be used in data transmission of speed up to 100 Mbps, in particular, Category 5 of the EIA/TIA provides standard specifications related to the minimum performance of un3acketed unit-type cables which are formed by cabling a plurality of units each including twisted insulated wire pairs.

However, these conventional communication cables, each composed of a plurality of insulated wire pairs twisted together, cannot enjoy those characteristics which are required by data communication of about 100 Mbps or more, such as high-speed data communication of 150 Mbps or thereabout in asynchronous computer networks (ATMLAN), high-frequency image communication for cable televisions (CATV), etc. In order to obtain the essential characteristics for high-speed or high-frequency data communication, a unit-type cable must be formed by cabling a plurality of communication cables which are composed of a plurality of twisted insulated wire pairs and constitute a unit each.

Thus, in the conventional method, the unit-type communication cable is manufactured by cabling the units which are each formed by simply twisting adjacent insulated wire pairs with different twist pitches. If the twist pitches of insulated wire pairs which constitute two adjacent units are equal, therefore, a satisfactory crosstalk characteristic cannot be obtained, that is, the crosstalk characteristic based on the standard specifications provided by the EIA/TIA cannot be achieved. In manufacturing the unit-type cable, Therefore, it is necessary to give consideration to the relationship between the twist pitches of insulated wire pairs which constitute each two adjacent units or each two alternate or every-third units, depending on the values of the twist pitches of the wire pairs, as well as the relationship between the twist pitches of the wire pairs in each unit.

It may be proposed, in this case, that the crosstalk characteristic should be improved by jacketing each unit to secure the insulation properties between the units, without giving consideration to the relationship between the twist pitches of the insulated wire pairs in each two adjacent units or the like. If each unit is jacketed, however, the resulting communication cable is large in diameter, heavy in weight, and not flexible enough for the purpose, and besides, entails an increase in cost.

In manufacturing unit-type communication cables, therefore, it is most advisable to take account of the twist pitches of insulated wire pairs in a plurality of units, in order to ensure a satisfactory crosstalk characteristic for high-speed data communication or high-frequency communication, without adversely affecting the favorable properties of the cables, such as thinness, lightness in weight, and good flexibility. However, conventional communication cables of this type cannot fulfill this requirement, and cannot enjoy a satisfactory crosstalk characteristic in high-speed data communication of 100 Mbps or thereabout. For the unit-type communication cables in the existing circumstances, in particular, no positive proposal has been made yet to determine the values for the combinations of twist pitches which can ensure an optimum crosstalk characteristic, even though the twist pitches of the insulated wire pairs in a plurality of units are taken into consideration.

With respect to communication cables having a plurality of insulated wire pairs, moreover, there is a proposition in the ISO/IEC-DIS 11801 (International Organization for Standardization/International Electrotechnical Commission, hereinafter referred to as "ISO/IEC") that a crosstalk attenuation based on the standard specifications (Category 5) of the EIA/TIA for electric wires which can be used in high-speed data communication of 100 Mbps should be given a margin which is substantially equivalent to the sum of a standard value and (6+10 log(n+1) dB (n is the number of units adjoined by a certain unit). Thus, the multiplex crosstalk characteristic, which is related to simultaneously delivered signals, is expected to be regulated more strictly.

SUMMARY OF THE INVENTION

The object of the present invention is to provide a communication cable which can eliminate the drawbacks described above, and in which a plurality of units, each formed by twisting a plurality of insulated wire pairs together, are cabled so that a satisfactory crosstalk characteristic can be secured for high-speed data communication or high-frequency communication at a high speed of 100 Mbps or more, without adversely affecting the thinness, lightness in weight, and Good flexibility of the cable.

In order to achieve the above object, according to the present invention, there is provided a communication cable which is formed by cabling a plurality of units in a manner such that each two adjacent units have different twist pitches, each unit including a plurality of insulated wire pairs twisted together so that each two adjacent insulated wire pairs have different twist pitches, and in which: a twist pitch $P_i$ of an insulated wire pair $T_i$ optionally selected among a plurality of insulated wire pairs which constitute a unit $U_i$, out of two adjacent units $U_i$ and $U_j$ optionally selected among the plurality of units, and a twist pitch $P_j$ of an insulated wire pair $T_j$ optionally selected among a plurality of insulated wire pairs which constitute the unit $U_j$ are different; the twist pitches $P_i$ and $P_j$ are both selected from a region which fulfills the following expressions (1) and (2) or expressions (1) and (3); and the twist pitch $P_i$ and a twist pitch $P_k$ of an insulated wire pair $T_k$ optionally selected among a plurality of insulated wire pairs which constitute a unit $U_k$, out of two optionally selected alternate units $U_i$ and $U_k$, are both selected from a region which fulfills the following expression (4) in the case where the twist pitches $P_i$ and $P_k$ are in compliance with prior conditions given by expression (4):

$$P_{ix}\times P_{jx}/d^2 \leqq 7,\ P_{iy}/P_{jy} \geqq 1.24\ (P_{iy}>P_{jy}),\ \text{or} \quad \ldots (1)$$

$$P_{iy}/P_{jy} \leqq 0.8\ (P_{iy}<P_{jy}), \quad \ldots (2)$$

in the case where there are relations, $144<P_{iy}\times P_{jy}/d^2 \leqq 413$, $$P_{iy}P_{jy} \geqq 1.09\ (P_{iy}>P_{jy}),\ \text{or}\ P_{iy}/P_{jy} \leqq 0.92\ (P_{iy}<P_{jy}), \quad \ldots (3)$$

in the case where there is a relation, $P_{iy}\times P_{jy}/d^2 \leqq 144$, and $$P_{iy}/P_{ky} \geqq 1.04\ (P_{iy}>P_{ky}),\ \text{or}\ P_{iy}/P_{ky} \leqq 0.96\ (P_{iy}<P_{ky}), \quad \ldots (4)$$

in the case where $P_{iy}/d>16.4$ and $P_{ky}/d>16.4$ are given as prior conditions, where $P_{ix}$ and $P_{jx}$ are unit diametrical components of the twist pitch $P_i$ of the insulated wire pair $T_i$ and the twist pitch $P_j$ of the insulated wire pair $T_j$, respectively, $P_{iy}$, $P_{jy}$ and $P_{ky}$ are unit lengthwise components of the twist pitch $P_i$ of the insulated wire pair $T_i$, the twist pitch $P_j$ of the insulated wire pair $T_j$, and the twist pitch $P_k$ of the insulated wire pair $T_k$, respectively, and d is the outside diameter of insulated wires which constitute the plurality of insulated wire pairs. In the description to follow, a subscript y affixed to symbol P for each twist pitch represents a unit lengthwise component for each twist pitch P.

Expressions (1) to (3) relate to the twist pitches of insulated wire pairs in each two adjacent units, while expression (4) relates to the twist pitches of insulated wire pairs in each two alternate units. As described above, expression (4) represents a condition which is expected to be fulfilled only when $P_{iy}/d>16.4$ and $P_{ky}/d>16.4$ are established. If these prior conditions are not fulfilled by one or either of the twist pitches $P_i$ and $P_k$, the condition given by expression (4) is a limitative condition which need not always be met. In other words, expression (4) is not specified in particular for the twist pitches of the insulated wire pairs except in the case where $P_{iy}/d>16.4$ and $P_{ky}/d>16.4$ are established.

In the case where one or both of the twist pitches $P_i$ and $P_k$ are in compliance with $P_{iy}/d \leqq 16.4$ and $P_{ky}/d \leqq 12.4$, therefore, the communication cable meets the requirements of claim 1 of the present invention without departing from the scope of claim 1 of the invention if expressions (1) and (2) or expressions (1) and (3) are fulfilled with respect to the relation between the twist pitches $P_i$ and $P_k$.

Preferably, the communication cable is designed so that the twist pitches of the insulated wire pairs fulfill the following conditions (a) to (d).

First, as the condition (a), the twist pitch $P_i$ of the insulated wire pair $T_i$ optionally selected among the insulated wire pairs which constitute the unit $U_i$ is selected from a region given by $P_{iy}/d \leqq 16.4$. Thus, in the unit $U_i$, the twist pitch of any of the insulated wire pairs is defined by $P_{iy}/d \leqq 16.4$, so that the twist pitches of all the wire pairs are selected from the region given by $P_{iy}/d \leqq 16.4$.

Then, as the condition (b), a twist pitch $P_{ja}$ of one insulated wire pair $T_{ja}$ among a plurality of insulated wire pairs which constitute the unit $U_j$ adjacent to the unit $U_i$ which fulfills the condition (a), with respect to the twist pitches $P_j$ of the insulated wire pairs which constitute the unit $U_j$, is set so as to be smaller than a minimum value $P_{i(min)}$ of the twist pitch $P_i$ ($P_{i(min)}>P_{ja}$), and the relation between the twist pitch $P_{ja}$ and the minimum value $P_{i(min)}$ of the twist pitch $P_i$ fulfills $p_{i(min)}/P_{jay} \geqq 1.09$ of expression (3). On the other hand, twist pitches $P_{jR}$ of the insulated wire pairs other than the one insulated wire pair $T_{ja}$, among the insulated wire pairs which constitute the unit $U_j$, is given by $P_i<P_{jR}$, and the relation between the twist pitches $P_{jR}$ and $P_i$ is set so as to fulfill $P_{iy}/P_{jRy} \leqq 0.8$ of expression (2).

Thus, the unit $U_j$ specified by the condition (b) is designed so that one of its insulated wire pairs has a twist pitch smaller than the minimum value $P_{i(min)}$ of the twist pitches of the insulated wire pairs which constitute the unit $U_i$, and all the twist pitches $P_{jR}$ of the other insulated wire pairs are set to be longer than the twist pitches of any insulated wire pairs which constitute the unit $U_i$. In this case, a minimum value $P_{j(min)}$ ($P_{ja}$) of the twist pitches of the insulated wire pairs which constitute the unit $U_j$ is set to be smaller than the minimum value $P_{i(min)}$ of the twist pitches of the insulated wire pairs which constitute the unit $U_i$ in which the twist pitches of all the insulated wire pairs are selected from the region given by $P_{iy}/d \leqq 16.4$. Thus, the minimum value $P_{j(min)}$ ($P_{ja}$) of the twist pitches of the insulated wire pairs which constitute the unit $U_j$ is also selected from the region which fulfills $P_{j(min)}/d \leqq 16.4$.

Further, as the condition (c), each of units $U_{il}$ to $U_{in}$ arranged alternately following the unit $U_i$ which fulfills the condition (a) is composed of a plurality of insulated wire pairs having the same twist pitches as the insulated wire pairs which constitute the unit $U_i$. Thus, the units $U_{il}$ to $U_{in}$ have quite the same twist pitch configuration. For example, if the twist pitches of the insulated wire pairs which constitute the unit $U_i$ are 9.0 mm, 10.0 mm, 11.0 mm, and 12.0 mm, individually (in the case the insulated-wire pairs are four in number), the twist pitches of the insulated wire pairs which constitute each of the units $U_{i1}$ to $U_{in}$ are also 9.0 mm, 10.0 mm, 11.0 mm, and 12.0 mm, individually.

Accordingly, the twist pitches of all the insulated wire pairs which constitute the units $U_{il}$ to $U_{in}$ arranged alternately following the unit $U_i$ fulfill the condition (a), and the relation specified by the condition (c) is established if the unit $U_i$ is replaced with any of the units $U_{il}$ to $U_{in}$. Thus, according to the condition (c), any of the units $U_{il}$ to $U_{in}$ can be taken for the unit $U_i$.

Finally, as the condition (d), a minimum value $P_{j1(min)}$ of twist pitches $P_{j1}$ of a plurality of insulated wire pairs which constitute a unit $U_{j1}$ next to the unit $U_j$ but one is set so as to be equal to the twist pitch $P_{ja}$ of a minimum value $P_{j(min)}$ of the twist pitch $P_j$ ($P_{j(min)}=P_{j1(min)}$), and $P_{jRy}/P_{j1Ry} \geqq 1.04$ is fulfilled when the relation between twist pitches $P_{j1R}$ other than the minimum value $P_{j1(min)}$ of the twist pitches $P_{j1}$ of the insulated wire pairs which constitute the unit $U_{j1}$ and twist pitches $P_{jR}$ other than the twist pitch $P_{ja}$ of the minimum value $P_{j(min)}$ of the twist pitch $P_j$ of the insulated wire pairs which constitute the unit $U_j$ which fulfills the condition (b) is given by $P_{jRy}>P_{j1Ry}$, and $P_{jRy}/P_{j1Ry} \leqq 0.96$ is fulfilled when the relation is given by $P_{jRy}<P_{j1Ry}$.

In this case, the relation between the twist pitches of a plurality of insulated wire pairs which constitute one unit and the twist pitches of a plurality of insulated wire pairs which constitute the other unit, out of two alternate units (e.g., units $U_{j1}$ and $U_2$, units $U_{j2}$ and $U_{j3}$, etc.) optionally selected among units $U_{j1}$ to $U_{jn}$ arranged alternately following the unit $U_j$ which fulfills the condition (b), is set so as to fulfill the condition (d).

As seen from the condition (b), in particular, claim 2 presents a region for the selection of the twist pitches of the insulated wire pairs in the case one insulated wire pair having a relatively short twist pitch is included in the one unit $U_j$, out of the two adjacent units.

In this case, the condition (b), among the conditions described above, relates to the relationship between the twist pitches of insulated wire pairs in each two adjacent units, while the conditions (c) and (d) relate to the relationship between the twist pitches of insulated wire pairs in each two alternate units. The communication cable specified by claim 2 can be described as follows. FIG. 6(B) shows one such communication cable 10 which includes six units 12A to 12F. More specifically, the communication cable 10 comprises the unit $U_i$ (unit 12A of FIG. 6(B)) as a base unit which meets the condition (a), units (units 12C and 12E) of the same type as the base unit $U_i$ arranged alternately according to the condition (c), unit $U_j$ (unit 12B) based on the condition (b), and units $U_{j1}$ and $U_{j2}$ (units 12D and 12F) arranged alternately following the unit $U_j$ according to the condition (d).

In this case, the condition (b) relates to the relationship between the twist pitches of the insulated wire pairs in the units $U_i$ (including the units $U_{i1}$ to $U_{in}$), which meet the condition (a), and the units $U_j$, $U_{j1}$ and $U_{j2}$ adjacent to the $U_i$. Thus, with respect to the communication cable shown in FIG. 6(B), for example, the condition (b) holds for any of combinations between the unit 12A and the units 12B and 12F, between the unit 12C and the units 12B and 12D, and between the unit 12E and the units 12D and 12F.

The condition (d) relates to the relationship between the twist pitches of the insulated wire pairs in the combinations of alternate units (e.g., units $U_j$ and $U_{j1}$, $U_{j1}$ and $U_{j2}$, and $U_{j2}$ and $U_j$, etc.) optionally selected among the three units including the unit $U_j$, which meets the condition (b), and the units $U_{j1}$ and $U_{j2}$ arranged alternately following the unit $U_j$. Thus, with respect to the communication cable shown in FIG. 6(B), for example, the condition (d) holds for any of combinations between the units 12B and 12D, between the units 12D and 12F, and between the units 12F and 12B.

According to claim 2, the conditions (c) and (d) relate to the relationship between the twist pitches of insulated wire pairs in each two alternate units. As specified by the condition (a), however, the twist pitches of the insulated wire pairs which constitute the unit $U_j$ are all in compliance with $P_{jy}/d \leqq 16.4$. Based on the conditions (c) and (d), moreover, the units $U_{j1}$ and $U_{j2}$, arranged alternately following the unit $U_j$, each include at least one insulated wire pair which has a twist pitch in compliance with $P_{j1y}/d \leqq 16.4$ and $P_{j2y}/d \leqq 16.4$. Thus, claim 2 also specifies the relationship between the relatively short twist pitches and the other ones.

In other words, claim 2 of the present invention specifies the regions which are not specified in particular by expression (4) of claim 1. More specifically, claim 2 further specifies the relationship between the twist pitches of the insulated wire pairs in each two alternate units of which the ratio between the unit lengthwise component and the outside diameter (d) of the insulated wires is 16.4 or less and the other twist pitches.

Thus, claim 2 of the present invention is within the scope of claim 1, so that the relation between the twist pitches in each two adjacent units $U_i$ and $U_j$ (including the units $U_i$ and $U_{j1}$ to $U_{jn}$), e.g., the units 12B and 12C shown in FIG. 6(B), must fulfill expression (2) or (3) of claim 1, as specified by the condition (b), not to mention expression (1). As specified by the condition (d), moreover, the relation between the twist pitches in each two alternate units, e.g., the units 12B and 12D shown in FIG. 6(B), must fulfill expression (4) unless a twist pitch is included such that the ratio between the unit lengthwise component and the outside diameter (d) of the insulated wires is 16.4 or less.

Further preferably, the communication cable is designed so that the twist pitches of the insulated wire pairs fulfill the following conditions (e) to (h).

First, as the condition (e), the twist pitch $P_i$ of the insulated wire pair $T_i$ optionally selected among the insulated wire pairs which constitute the unit $U_i$ is selected from the region given by $P_{iy}/d \leqq 16.4$. This condition (e) is identical with the condition (a) of claim 2.

Then, as the condition (f), twist pitches $P_{ja}$ and $P_{jb}$ of two insulated wire pairs $T_{ja}$ and $T_{jb}$ among the insulated wire pairs which constitute the unit $U_j$ adjacent to the unit $U_i$ which fulfills the condition (e), with respect to the twist pitch $P_j$ of the insulated wire pairs which constitute the unit $U_j$, are set so as to be smaller than the minimum value $P_{i(min)}$ of the twist pitch $P_i$ ($P_{i(min)}>P_{ja}$, $P_{i(min)}>P_{jb}$), and the relation between the twist pitch $P_{ja}$ and the minimum value $P_{i(min)}$ of the twist pitch $P_i$ and the relation between the twist pitch $P_{jb}$ and the minimum value $P_{i(min)}$ fulfill $P_{i(min)y}/P_{jay} \geqq 1.09$ and $P_{i(min)y}/P_{jby} \geqq 1.09$ of the expression (3), respectively. On the other hand, the twist pitches $P_{jR}$ of the insulated wire pairs other than the two insulated wire pairs $T_{ja}$ and $T_{jb}$, among the insulated wire pairs which constitute the unit $U_j$, are given by $P_i<P_{jR}$, and the relation between the twist pitches $P_{jR}$ and the twist pitch $P_i$ is set so as to fulfill $P_{iy}/P_{jRy} \leqq 0.8$ of the expression (2).

According to the condition (b) of claim 2, only one of the insulated wire pairs has the twist pitch smaller than the minimum value $P_{i(min)}$ of the twist pitches of the insulated wire pairs which constitute the unit $U_i$. In contrast with this, the unit $U_j$ specified by the condition (j) include two insulated wire pairs which has such a short twist pitch, and, like the one specified by the condition (b) of claim 2, is designed so that all the twist pitches $P_{jR}$ of the other insulated wire pairs are longer than the twist pitches of any insulated wire pairs which constitute the unit $U_i$.

Also in this case, therefore, the twist pitches $P_{ja}$ and $P_{jb}$, out of the twist pitches of the insulated wire pairs which constitute the unit $U_j$, are selected from regions which fulfill $P_{ja}/d \leqq 16.4$ and $P_{jb}/d \leqq 16.4$, respectively.

As the condition (g), moreover, each of the units $U_{i1}$ to $U_{in}$ arranged alternately following the unit $U_i$ which fulfills the condition (e) is composed of a plurality of insulated wire pairs having the same twist pitches as the insulated wire pairs which constitute the unit $U_i$. This condition (g) is also identical with the condition (c) of claim 2.

Finally, as the condition (h), twist pitches $P_{j1a}$ and $P_{j1b}$ of two insulated wire pairs $T_{j1a}$ and $T_{j1b}$, out of the insulated wire pairs which constitute the unit $U_{j1}$ next to the unit $U_j$ but one are set so as to be equal to the twist pitches $P_{ja}$ and $P_{jb}$ ($P_{ja}=P_{j1a}$, $P_{jb}=P_{j1b}$), respectively, of the two insulated wire pairs $T_{ja}$ and $T_{jb}$ which are smaller than the minimum value $P_{i(min)}$ of the twist pitch $P_i$ of the insulated wire pairs which constitute the unit $U_i$ which fulfills the condition (e), and $P_{jRy}/P_{j1Ry} \geqq 1.04$ is fulfilled the expression (4) when the relation between twist pitches $P_{j1R}$ other than the twist pitches $P_{j1a}$ and $P_{j1b}$, out of the twist pitches $P_{j1}$ of the insulated wire pairs which constitute the unit $U_{j1}$, and twist pitches $P_{jR}$ other than the twist pitches $P_{ja}$ and $P_{jb}$, out of the twist pitches $P_j$ of the insulated wire pairs which constitute the unit $U_j$ which fulfills the condition (f), is given by $P_{jRy}>P_{j1Ry}$, and $P_{jRy}/P_{j1Ry} \leqq 0.96$ is fulfilled when the relation is given by $P_{jRy}<P_{j1Ry}$.

In this case, the relation between the twist pitches of a plurality of insulated wire pairs which constitute one unit and the twist pitches of a plurality of insulated wire pairs which constitute the other unit, out of two alternate units optionally selected among the units $U_{j1}$ to $U_{jn}$ arranged alternately following the unit $U_j$ which fulfills the condition (f), is set so as to fulfill the condition (h). This condition (h) corresponds to the condition (d) of claim 2.

As seen from the condition (f), in particular, claim 3 presents a region for the selection of the twist pitches in the case two insulated wire pairs having a relatively short twist pitch are included in the one unit $U_j$, out of the two adjacent units, and is identical with claim 2 except for the arrangement of the two short-pitch wire pairs. Thus, claim 3 is substantially the same as claim 2 with respect to the unit arrangement, the way of application of the conditions to the individual unit combinations, and the relation to claim 1.

If the twist pitches of the insulated wire pairs are limited in value in this manner, the twist pitches of insulated wire pairs which constitute one unit never fail to be different from those of insulated wire pairs which constitute the adjacent units, and these individual insulated wire pairs are twisted together with twist pitches of optimum values obtained experimentally. Thus, high-speed data communication and high-frequency communication at a high speed of about 100 Mbps or more can be ensured with a satisfactory crosstalk characteristic without specially jacketing each unit.

According to the present invention, the twist pitches of a plurality of insulated wire pairs are restricted within the predetermined limits, so that the twist pitches of insulated wire pairs which constitute one unit never fail to be different from those of insulated wire pairs which constitute the adjacent units, and these individual insulated wire pairs are twisted together with optimum twist pitches obtained experimentally. Accordingly, the communication cables of the present invention can be used in high-speed data communication and-high-frequency communication with a satisfactory crosstalk characteristic. Since the communication cables can enjoy the satisfactory crosstalk characteristic without any jacket on each unit, in particular, they can be reduced in diameter and weight, and hence, in manufacturing cost, and have good flexibility. Thus, the communication cables of the invention can be easily arranged under the floor or in conduits, trays, etc.

The above and other objects, features, and advantages of the invention will be more apparent from the ensuing detailed description taken in connection with the accompanying drawings.

DETAILED DESCRIPTION OF THE PREFERRED EMBODIMENTS

Figure 1:
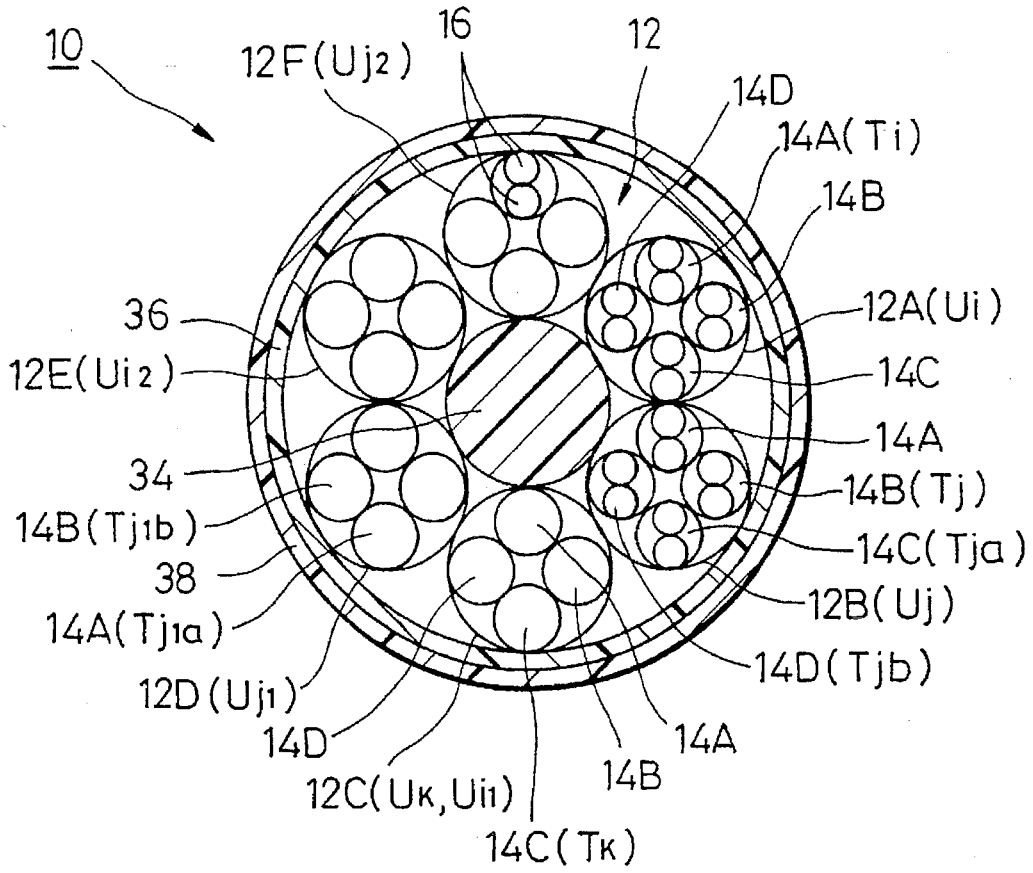
FIG. 1 is a sectional view of a communication cable according to the present invention.

Preferred embodiments of the present invention will now be described in detail with reference to the accompanying drawings. FIG. 1 shows a communication cable 10 according to the invention. The cable 10 is formed by cabling a plurality of units 12 around a filler 34 which is used as required, covering the cabled units by means of a binding tape 36, and covering the tape 36 by means of a jacket 38.

Thus, the communication cable 10 of the present invention is a communication cable of the so-called unit type, and is conformable to the standard specifications for electric wires which can be used in high-speed data communication of 100 Mbps or thereabout provided by the EIA/TIA. Accordingly, the communication cable 10 of the present invention is adapted for use in high-speed data communication in private wiring systems for commercial buildings or the like. Recently, there has been an increasing demand for the private wiring systems.

Although the communication cable 10 is composed of six units 12A to 12F in the embodiment shown in FIG. 1, it may be formed of any other suitable number of units, if necessary.

Figure 2:
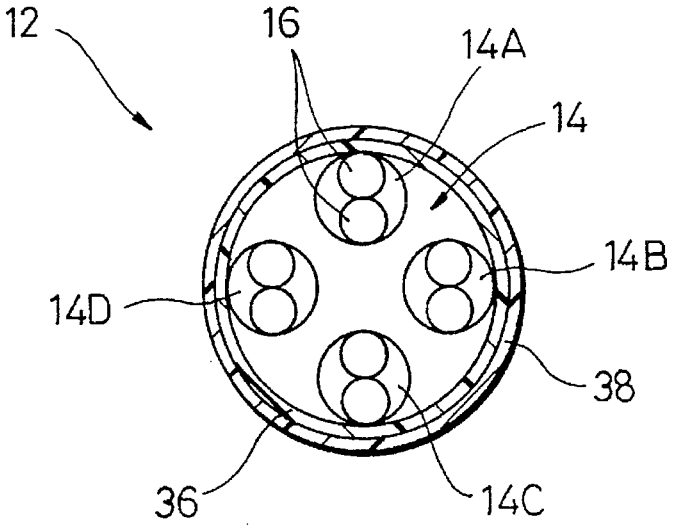
FIG. 2 is a sectional view of a cable section or unit used in the invention.

As shown in FIGS. 1 and 2, each of the units 12A to 12F is formed by twisting a plurality of insulated wire pairs 14 together. Although each unit 12 is composed of four insulated wire pairs 14A to 14D in the embodiment shown in FIGS. 1 and 2, it may be formed of any other suitable number of wire pairs, if necessary. Thus, each of the six units 12A to 12F is formed of four insulated wire pairs 14A to 14D, so that the communication cable 10 shown in FIG. 1 includes 24 insulated wire pairs 14 in total.

The units 12 are twisted together in a manner such that each two adjacent ones have different twist pitches. In the present invention, the twist pitch of each unit 12 is a pitch with which the four insulated wire pairs 14A to 14D of the unit 12 are twisted together.

Figure 3:
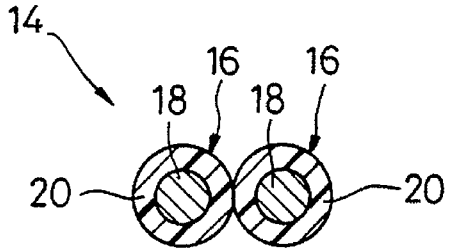
FIG. 3 is a sectional view of an insulated wire pair used in the invention.

As shown in FIG. 2, each insulated wire pair 14 is formed by twisting twin-core insulated wires 16 together. As shown in FIG. 3, each insulated wire 16 is formed by covering a conductor 18 with an insulating layer 20. For example, an annealed copper wire or the like may be used as the conductor 18, and the insulating layer 20 may be formed of polyethylene or the like.

The four insulated wire pairs 14A to 14D are twisted together in a manner such that each two adjacent ones have different twist pitches lest crosstalk be caused. Thus, a twist pitch $P_A$ of one insulated wire pair 14A, out of each two adjacent insulated wire pairs 14A and 14B shown in FIGS. 1 and 2, is different from a twist pitch $P_B$ of the other pair 14B. This also applies to the relations between the insulated wire pairs 14B and 14C; 14C and 14D; and 14D and 14A. More specifically, if the twist pitches of the insulated wire pairs 14A, 14B, 14C and 14D are $P_A$, $P_B$, $P_C$ and $P_D$, respectively, $P_A \neq P_B$, $P_B \neq P_C$, $P_C \neq P_D$, and $P_D \neq P_A$ hold at all times.

In the present invention, the twist pitch of each insulated wire pair 14 is a pitch with which the twincore insulated wires 16 of the wire pair 14 are twisted together.

According to the present invention, a twist pitch $P_i$ of an insulated wire pair $T_i$ optionally selected among a plurality of insulated wire pairs 14 which constitute one unit $U_i$, out of two adjacent units $U_i$ and $U_j$ optionally selected among a plurality of units 12, and a twist pitch $P_j$ of an insulated wire pair $T_j$ optionally selected among the insulated wire pairs 14 which constitute the other unit $U_j$ are both selected from a region which fulfills the following expressions (1) and (2) for a combination of insulated wire pairs 14 based on $144 < P_{iy} \times P_{jy}/d^2 \leqq 413$ and from a region which fulfills the expressions (1) and (3) for a combination of pairs 14 based on $P_{iy} \times P_{jy}/d^2 \leqq 144$.

For unit diametrical components $P_{ix}$ and $P_{jx}$, expression (1) is given as follows:

$$P_{ix} \times P_{jx}/d^2 \leqq 7. \quad \ldots (1)$$

For unit lengthwise components $P_{iy}$ and $P_{jy}$, moreover, expression (2) is given as follows:

$$P_{iy}/P_{jy} \geqq 1.25\ (P_{iy} > P_{jy}),\ \text{or}\ P_{iy}/P_{jy} \leqq 0.8\ (P_{iy} < P_{jy}), \quad \ldots (2)$$

in the case where there are relations, $144 < P_{iy} \times P_{jy}/d^2 \leqq 413$, and expression (3) is given as follows:

$$P_{iy}/P_{jy} \geqq 1.09\ (P_{iy} > P_{jy}),\ \text{or}\ P_{iy}/P_{jy} \leqq 0.92\ (P_{iy} < P_{jy}), \quad \ldots (3)$$

in the case where there is a relation, $P_{iy} \times P_{jy}/d^2 \leqq 144$.

According to the present invention, furthermore, if the twist pitch $P_i$ of the insulated wire pair $T_i$ optionally selected among a plurality of insulated wire pairs 14 which constitute the one unit $U_i$, out of two alternate units $U_i$ and $U_k$ optionally selected among a plurality of units 12, and a twist pitch $P_k$ of an insulated wire pair $T_k$ optionally selected among the insulated wire pairs 14 which constitute the other unit $U_k$ are both in compliance with $P_{iy}/d > 16.4$ and $P_{ky}/d > 16.4$, they are both selected from a region which fulfills the following expression (4).

For unit lengthwise components $P_{iy}$ and $P_{ky}$, expression (4) is given as follows:

$$P_{iy}/P_{ky} \geqq 1.04\ (P_{iy} > P_{ky}),\ \text{or}\ P_{iy}/P_{ky} \leqq 0.96\ (P_{iy} < P_{ky}), \quad \ldots (4)$$

in the case where $P_{iy}/d > 16.4$ and $P_{ky}/d > 16.4$ are given as prior conditions.

According to the present invention, the respective twist pitches of the insulated wire pairs 14 are selected from a region which fulfills expressions (1) and (2) or expressions (1) and (3) for the two adjacent units $U_i$ and $U_j$, or from a region which additionally fulfills expression (4) for the two alternate units $U_i$ and $U_k$ in the case where the prior conditions of expression (4) are fulfilled.

Thus, the twist pitch of one insulated wire pair $T_i$ among a plurality of insulated wire pairs 14 which constitute the unit $U_i$, for example, must fulfill expressions (1) and (2) or expressions (1) and (3) with respect to the twist pitches of a plurality of insulated wire pairs 14 which constitute the adjacent unit $U_j$, or expression (4) with respect to the twist pitches of a plurality of insulated wire pairs 14 which constitute the alternate unit $U_k$. In this case, expression (4) related to the two alternate units $U_i$ and $U_k$ represents a condition which is expected to be fulfilled only when the two twist pitches $P_i$ and $P_k$ whose relation should be taken into consideration constitute a combination of relatively long twist pitches based on $P_{iy}/d > 16.4$ and $P_{ky}/d > 16.4$. If these prior conditions are not fulfilled by one or either of the twist pitches $P_i$ and $P_k$, they are limitative conditions which need not always be met.

In other words, expression (4) is not specified in particular for the twist pitches of the insulated wire pairs 14 except in the case where $P_{iy}/d>16.4$ and $P_{ky}/d>16.4$ are established. In the case where one or both of the twist pitches $P_i$ and $P_k$ are in compliance with $P_{iy}/d\leqq 16.4$ and $P_{ky}/d\leqq 16.4$, therefore, the communication cable meets the requirements of the present invention without departing from the scope of the invention if expressions (1) and (2) or expressions (1) and (3) are fulfilled with respect to the relation between the twist pitches $P_i$ and $P_k$. Table 1 shows the application of expressions (1) to (4) for individual combinations of twist pitches to be examined. According to the present invention, it is necessary only that any of the relations be established.

Figure 4:
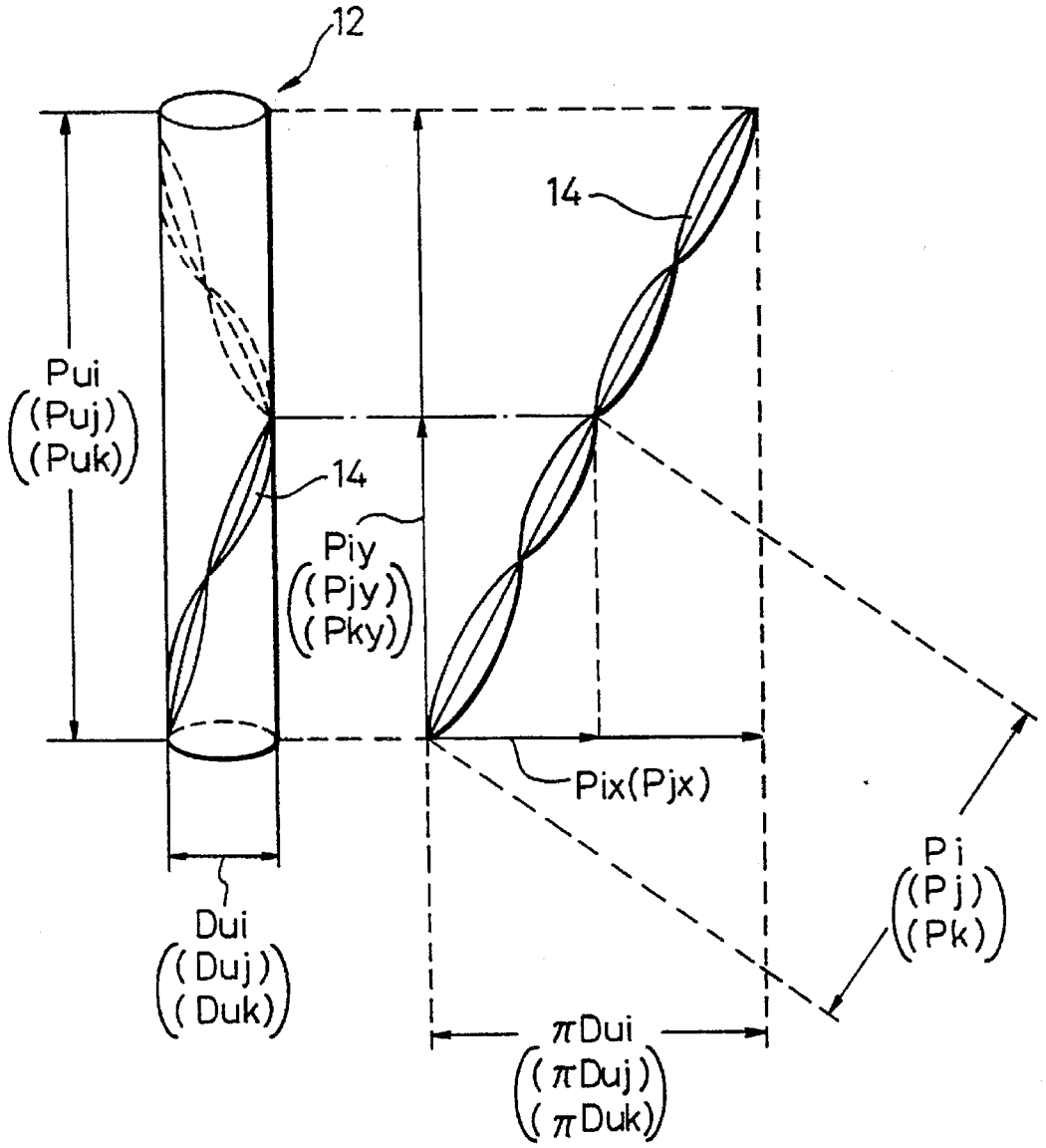
FIG. 4 is an exploded view showing unit diametrical components and unit lengthwise components of an insulated wire pair in a unit.

In expressions (1) to (4), $P_{ix}$ and $P_{jx}$ represent the unit diametrical components for the twist pitches $P_i$ and $P_j$ of the insulated wire pairs $T_i$ and $T_j$, respectively, as shown in FIG. 4. Also, $P_{iy}$, $P_{jy}$ and $P_{ky}$ represent the unit lengthwise components for the twist pitches $P_i$, $P_j$ and $P_k$ of the insulated wire pairs $T_i$, $T_j$ and $T_k$, respectively, as shown in FIG. 4. In the description hereof, subscript x affixed to symbol P for each twist pitch represents a unit diametrical component for each twist pitch P.

TABLE 1

| | $P_{iy}/d$ | | | Applicable expressions | |
|---|---|---|---|---|---|
| | | | | Between adjacent | Between alternate |
| | One | Other | | units | units |
| 1 | >16.4 | >16.4 | *(1) | (1) (2) | (4) |
| | | | *(2) | (1) (3) | (4) |
| 2 | ≦16.4 | >16.4 | *(1) | (1) (2) | — |
| | | | *(2) | (1) (3) | — |
| 3 | >16.4 | ≦16.4 | *(1) | (1) (2) | — |
| | | | *(2) | (1) (3) | — |
| 4 | ≦16.4 | ≦16.4 | *(1) | (1) (2) | — |
| | | | *(2) | (1) (3) | — |

Note:
*(1) $144 < P_{iy} \times P_{jy}/d^2 \leqq 413$
*(2) $P_{iy} \times P_{jy}/d^2 \leqq 144$ Thus, according to the present invention, each of the twist pitches $P_i$ and $P_j$ of the insulated wire pairs $T_i$ and $T_j$ is reduced to two components, a unit diametrical component and a unit lengthwise component, and the twist pitch $P_k$ of the insulated wire pair $T_k$ is converted into a unit lengthwise component.

If the twist pitch and outside diameter of the unit $U_i$ having the insulated wire pair $T_i$ are expressed as $P_{ui}$ and $D_{ui}$, respectively, as shown in FIG. 4, the unit diametrical component $P_{ix}$ and unit lengthwise component $P_{iy}$ of the twist pitch $P_i$ of the insulated wire pair $T_i$ can be obtained according to the following expressions (5) and (6).

$$P_{ix}=[\pi D_{ui}/\{P_{ui}^2+(\pi D_{ui})^2\}^{1/2}]\times P_i, \quad \ldots (5)$$

$$P_{iy}=[P_{ui}/\{P_{ui}^2+(\pi D_{ui})^2\}^{1/2}]\times P_i. \quad \ldots (6)$$

Moreover, if the twist pitch and outside diameter of the unit $U_j$ having the insulated wire pair $T_j$ are expressed as $P_{uj}$ and $D_{uj}$, respectively, and if $P_{ui}$ and $D_{ui}$ of expressions (5) and (6) are replaced with $P_{uj}$ and $D_{uj}$, respectively, the unit diametrical component $P_{jx}$ and unit lengthwise component $P_{jy}$ of the twist pitch $P_j$ of the insulated wire pair $T_j$ can be obtained in like manner. Likewise, the unit lengthwise component of the twist pitch $P_k$ of the insulated wire pair $T_k$ can be obtained if the twist pitch and outside diameter of the unit $U_k$ having the insulated wire pair $T_k$ are expressed as $P_{uk}$ and $D_{uk}$, respectively, and if $P_{ui}$ and $D_{ui}$ of expression (6) are replaced with $P_{uk}$ and $D_{uk}$, respectively, If the twist pitches of the insulated wire pairs 14 are limited in values in this manner, a satisfactory crosstalk characteristic can be obtained even when they are used in high-speed data communication or high- frequency communication at a frequency of about 100 Mbps or more, as seen from experimental examples and embodiments, which will be described later.

Referring now to FIG. 1, for example, the aforementioned expressions (1) to (3), that is, the relations between the twist pitches of the insulated wire pairs 14 in each two adjacent units 12 will be described.

The twist pitch $P_A$ of the insulated wire pair 14A optionally selected among a plurality of insulated wire pairs 14 which constitute the unit 12A is reduced to a unit diametrical component $P_{Ax}$ and a unit lengthwise component $P_{Ay}$, and the twist pitch $P_B$ of the insulated wire pair 14B optionally selected among a plurality of insulated wire pairs 14 which constitute the unit 12B adjacent to the unit 12A is reduced to a unit diametrical component $P_{Bx}$ and a unit lengthwise component $P_{By}$. Let us suppose that the outside diameter of the insulated wires 16 which constitute each insulated wire pair 14 shown in FIG. 1 is d. The twist pitch for each direction is selected from a region which fulfills the following expressions (1*a*) and (2*a*) for the case where the combination of the insulated wire pairs 14A and 14B is based on $144<P_{Ay}\times P_{By}/d^2\leqq 413$, or from a region which fulfills the following expressions (1*a*) and (3*a*) for the case where combination is based on $P_{Ay}\times P_{By}/d^2\leqq 144$.

For the unit diametrical components $P_{Ax}$ and $P_{Bx}$, expression (1*a*) is given as follows:

$$P_{Ax}\times P_{Bx}/d^2\leqq 7. \quad \ldots (1a)$$

For the unit lengthwise components $P_{Ay}$ and $P_{By}$, expression (2*a*) is given as follows:

$$P_{Ay}/P_{By}\geqq 1.25\ (P_{Ay}>P_{By}),\ \text{or}\ P_{Ay}/P_{By}\leqq 0.8\ (P_{Ay}<P_{By}), \quad \ldots (2a)$$

in the case where there are relations, $144<P_{Ay}\times P_{Ay}/d^2\leqq 413$, and expression (3*a*) is given as follows:

$$P_{Ay}/P_{By}\geqq 1.09\ (P_{Ay}>P_{By}),\ \text{or}\ P_{Ay}/P_{By}\leqq 0.92\ (P_{Ay}<P_{By}), \quad \ldots (3a)$$

in the case where there is a relation, $P_{Ay}\times P_{By}/d^2\leqq 144$.

In the communication cable 10 shown in FIG. 1, as mentioned before, the twist pitches of the optionally selected insulated wire pairs 14 in the adjacent units 12A and 12F, 12B and 12C, 12C and 12D, 12D and 12E, and 12E and 12F are reduced to a unit diametrical component and a unit lengthwise component each, and the twist pitch for each direction is selected according to expressions (1*a*) to (3*a*).

In this case, the aforesaid relation must be fulfilled for the insulated wire pairs 14 which constitute each unit 12 of the four insulated wire pairs 14A to 14D in the illustrated embodiment. Therefore, expressions (1*a*) to (3*a*) require examination for all the combinations of the four insulated wire pairs 14A to 14D of each two adjacent units 12.

Thus, with respect to the units 12A and 12B, for example, expressions (1*a*) and (2*a*) or expressions (1*a*) and (3*a*) must be fulfilled for all of 16 combinations of insulated wire pairs (e.g., combination of the insulated wire pair 14B of the unit 12A and the insulated wire pair 14C of the unit 12B, etc.), including the insulated wire pair 14A of the unit 12A and the insulated wire pair 14B of the unit 12B.

Referring also to FIG. 1, expression (4), that is, the relation between the twist pitches of the insulated wire pairs 14 in each two alternate adjacent units 12 will be described.

The twist pitch $P_A$ of the insulated wire pair 14A optionally selected among a plurality of insulated wire pairs 14 which constitute the unit 12A is converted into the unit lengthwise component $P_{Ay}$, and the twist pitch $P_C$ of the insulated wire pair 14C optionally selected among a plurality of insulated wire pairs 14 which constitute the unit 12C adjacent to the unit 12A but one is reduced to a unit lengthwise component $P_{By}$. In this case, if the twist pitches $P_A$ and $P_C$ of the insulated wire pairs 14A and 14C are based on $P_{Ay}/d>16.4$ and $P_{Cy}/d>16.4$, respectively, they are further selected from a region which fulfills the following expression (4a).

$$P_{Ay}/P_{Cy} \geqq 1.04\ (P_{Ay}>P_{Cy}),\ \text{or}\ P_{Ay}/P_{Cy} \leqq 0.96\ (P_{Ay}<P_{Cy}), \quad \ldots (4a)$$

in the case where $P_{Ay}/d>16.4$ and $P_{Cy}/d>16.4$ are given as prior conditions.

The twist-pitches of the optionally selected insulated wire pairs 14 in the other alternate units 12A and 12E, 12B and 12D, 12B and 12F, 12C and 12E, and 12D and 12F are reduced to a unit lengthwise component each, and each twist pitch is selected according to expression (4a) in the case where the prior conditions of expression (4a) are met.

Also in this case, the aforesaid relation must be fulfilled for the insulated wire pairs 14 which constitute each unit 12 of the four insulated wire pairs 14A to 14D in the illustrated embodiment if the prior conditions of expression (4a) are met. Therefore, expression (4a) requires examination for all the combinations of the four insulated wire pairs 14A to 14D of each two alternate units 12. Thus, with respect to the units 12A and 12C, for example, expression (4a) must be fulfilled for all of 16 combinations of insulated wire pairs 14 (e.g., combination of the insulated wire pair 14B of the unit 12A and the insulated wire pair 14D of the unit 12C, etc.), including the insulated wire pair 14A of the unit 12A and the insulated wire pair 14C of the unit 12C, if the prior conditions of expression (4a) are met.

Expression (4a) must be fulfilled only in the case where the combinations of twist pitches to be examined are in compliance with $P_{Ay}/d>16.4$ and $P_{Cy}/d>16.4$, as mentioned before. In the case where one or both of the respective twist pitches $P_A$ and $P_C$ of the insulated wire pairs 14A and 14C are in compliance with $P_{Ay}/d \leqq 16.4$ and $P_{Cy}/d \leqq 16.4$, therefore, expression (4a) need not be fulfilled for the relation between the twist pitches $P_A$ and $P_C$. Accordingly, the twist pitch $P_A$ of the insulated wire pair 14A optionally selected among a plurality of insulated wire pairs 14 which constitute the unit 12A is expected only to fulfill either expressions (1) and (2) or expressions (1) and (3) in relation to the insulated wire pairs 14 which constitute the adjacent unit 12B.

Thus, in selecting the twist pitches of the insulated wire pairs 14 so as to fulfill the twist pitch selection regions for the insulated wire pairs 14, expressions (1) and (2) or expressions (1) and (3) must be fulfilled for relations between one insulated wire pair as an object of examination and a plurality of insulated wire pairs 14 which constitute a unit 12 adjacent to the unit 12 which includes the one wire pair as the object. Then, for relations between a plurality of insulated wire pairs 14 which constitute the alternate units 12, it is examined whether or not the twist pitch of the one insulated wire pair 14 as the object of examination and the twist pitch of the other insulated wire pair 14 in each alternate unit 12 are both in compliance with $P_{iy}/d>16.4$ and $P_{ky}/d>16.4$. If these conditions are not met, it is necessary only to give consideration to the relations between the insulated wire pairs 14 which constitute adjacent units 12, and further examination is unnecessary.

In the communication cable 10 according to the present invention, moreover, the insulated wire pair $T_i$ optionally selected among the insulated wire pairs 14 which constitute the one unit $U_i$, out of the two adjacent units $U_i$ and $U_j$ optionally selected among the units 12, and the insulated wire pair $T_j$ optionally selected among the insulated wire pairs 14 which constitute the other unit $U_j$ are twisted together with different twist pitches.

As shown in FIG. 1, for example, therefore, the insulated wire pair 14A, optionally selected among the insulated wire pairs 14 which constitute the unit 12A, and the insulated wire pair 14A, optionally selected among the insulated wire pairs 14 which constitute the unit 12B adjacent to the unit 12A, and the insulated wire pair 14A, optionally selected among the insulated wire paires 14 which constitute the unit 12F, should be arranged so as to have different twist pitches. This is because the crosstalk characteristic will be lowered if the insulated wire pair 14A of the unit 12A and the respective insulated wire pairs 14A of the unit 12B and 12F adjoin one another. It is to be understood that the twist pitches of the insulated wire pairs 14 optionally selected among the other adjacent units 12B and 12C, 12C and 12D, 12D and 12E, and 12E and 21F should be differentiated.

Figure 5:
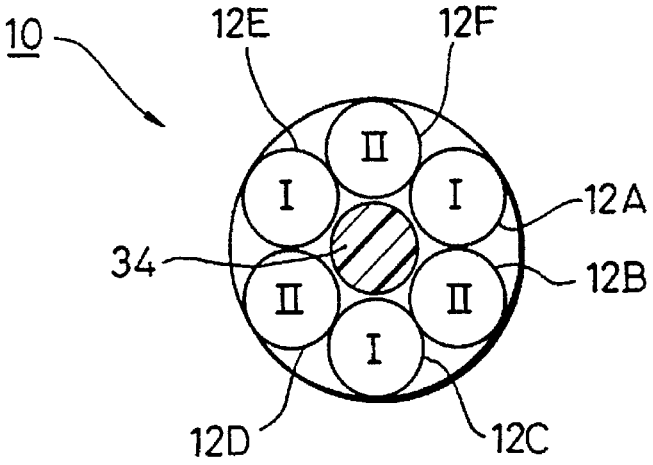
FIG. 5 is a schematic view showing an arrangement of units used in an experimental example according to the invention.

In this case, as shown in FIG. 5, the units 12 are classified into two types, Type I having insulated wire pairs 14 twisted with predetermined twist pitches and Type II having insulated wire pairs 14 twisted with twist pitches different from those of Type I. These units 12 of Types I and II are arranged alternately. Thus, the insulated wire pairs 14 in all the adjacent units 12 may be adjusted to different twist pitches.

In order to obtain a better crosstalk characteristic, according to the present invention, however, it is necessary to give consideration to the twist pitches of the insulated wire pairs 14 in each two alternate units 12, as well as each two adjacent units 12.

If the respective twist pitches of two insulated wire pairs 14 in each two alternate units 12, whose relation should be taken into consideration, are both long, the crosstalk characteristic is liable to be lowered, in general. Accordingly, a problem lies, in particular, in the relation for the case where the twist pitches of the insulated wire pairs 14, which also constitute the prior conditions of expression (4), are relatively long ones based on $P_{iy}/d>16.4$ and $P_{ky}/d>16.4$.

Figure 6A:
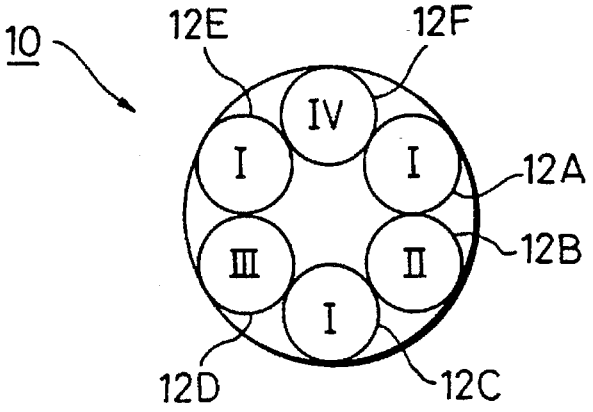
FIGS. 6A and 6B are schematic views showing an arrangement of units used in the invention.
Figure 6B:
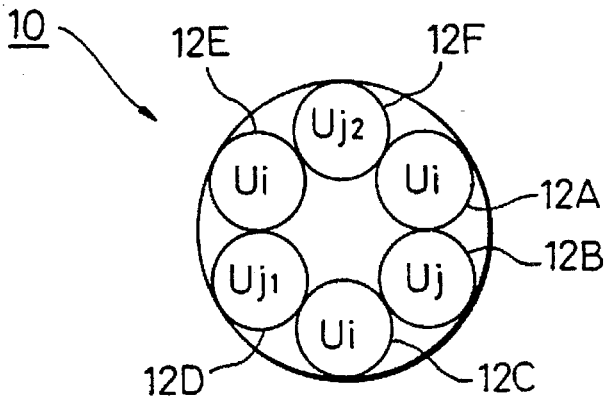

As shown in FIG. 6A, therefore, those units 12 in which the twist pitches of the insulated wire pairs 14 are all in compliance with $P_{iy}/d \leqq 16.4$ are classified as Type I. On the other hand, Type II covers those units 12 which include insulated wire pairs 14 whose twist pitches are different from those of the insulated wire pairs 14 which constitute the units 12 of Type I, and are based on $P_{jy}/d>16.4$. These units 12 of Types I and II are regarded as basic units.

The twist pitches of the insulated wire pairs 14 in each two alternate units 12 of Type I are both in compliance with $P_{iy}/d \leqq 16.4$. If these two types of units are simply alternately arranged, as shown in FIG. 5, therefore, there is no problem on the crosstalk characteristic.

In case of the units 12 of Type II, however, expression (4) cannot be fulfilled by the relations between the twist pitches of the same value, among the twist pitches of the insulated wire pairs 14 based on $P_{jy}/d>16.4$. Accordingly, units 12 of Type III are provided such that the twist pitches of their insulated wire pairs 14 are selected so as to fulfill expression (4) with respect to those of the insulated wire pairs 14 which constitute the units 12 of Type II. Also provided are units of Type IV whose insulated wire pairs 14 have twist pitches selected so as to fulfill expression (4) with respect to those of the insulated wire pairs 14 which constitute the units 12 of Type III. These four types of units 12 are arranged in the order of Type I, Type II, Type I, Type III, Type I, and Type IV, as shown in FIG. 6A.

In the embodiment shown in FIG. 6A, the four types of units 12 are provided for the communication cable 10 which has six units 12. In the case of a communication cable which has eight units 12, for example, however, the units 12 may be composed of five types. For other numbers of units, other corresponding numbers of types should be set as required.

Thus, the units 12 of the four types, Type I (see FIG. 6A) and Types II to IV, in which the twist pitches of the insulated wire pairs 14 are selected so as to fulfill either expressions (1) and (2) or expressions (1) and (3), and in the case where the prior conditions are met, the twist pitches of the insulated wire pairs 14 are selected so as to fulfill expression (4), are set and arranged in the manner shown in FIG. 6A. Thereupon, the communication cable 10 can be designed so that the twist pitches of all the insulated wire pairs 14 in each two adjacent units 12 are different. Also in the case where the twist pitches of the insulated wire pairs 14 in each two alternate units 12 are in compliance with $P_{jy}/d>16.4$, expression (4) can be fulfilled. In consequence, the communication cable 10 can be arranged so that all the insulated wire pairs 14 in each two adjacent units 12 have different twist pitches.

In FIG. 1, for example, the twist pitch $P_A$ of the insulated wire pair 14A, optionally selected among the insulated wire pairs 14 which constitute the unit 12A, and the twist pitch $P_A$ of the insulated wire pair 14A, optionally selected among the insulated wire pairs which constitute the unit 12B adjacent to the unit 12A, are always different. Also, the twist pitch PB of the insulated wire pair 14B, optionally selected among the insulated wire pairs 14 which constitute the unit 12B, and the twist pitch $P_D$ of the insulated wire pair 14D, optionally selected among the insulated wire pairs 14 which constitute the unit 12D adjacent to the unit 12B but one, are different and fulfill the relation given by expression (4) if they are in compliance with $P_{By}/d>16.4$ and $P_{Dy}/d>16.4$.

The processes of obtaining expressions (1) to (3) will now be described in detail with reference to one experimental example shown in Tables 2 and 3.

Table 2 shows the performance specifications of communication cables 10 according to various experimental examples which were prepared in order to obtain optimum set values of the pitch number of the insulated wire pairs 14.

Each communication cable 10 was manufactured by cabling six units 12 (outside diameter: 3.77 mm) around the filler 34, as shown in FIG. 1. Each unit 12 includes four insulated wire pairs 14 each composed of insulated wires 16 which were each formed by covering a conductor (annealed copper wire) having an outside diameter of 0.511 mm with an insulating layer (low- density polyethylene) having an outside diameter of 0.92 mm, as shown in Table 2.

TABLE 2

| | | | | Examples 1 to 4 (common) |
|---|---|---|---|---|
| Conductor | Material | | | Annealed copper wire |
| | Outside diameter (mm) | | | 0.511 |
| Insulating layer | Material | | | Low-density polyethylene |
| | Outside diameter (mm) | | | 0.92 |

TABLE 2-continued

| | | | | Examples 1 to 4 (common) |
|---|---|---|---|---|
| Pair twisting (twisted of twin-core insulated wires) | Pitch (mm) | Type I | (1) | 10 |
| | | | (2) | 14 |
| | | | (3) | 18 |
| | | | (4) | 22 |
| | | Type II | (5) | 12 |
| | | | (6) | 16 |
| | | | (7) | 20 |
| | | | (8) | 24 |
| Cabling (twisting of six units) | Method | | | Alternate arrangement Types I and II |
| | Pitch | | | 210 mm |
| Binding tape | Method | | | Plastic tape wrappings |
| Jacket | Material | | | PVC resin |

TABLE 3

| | | Example 1 | Example 2 | Example 3 | Example 4 |
|---|---|---|---|---|---|
| Unit twisting (twisting of four pairs) (mm) | Type I | 30 | 50 | 70 | 110 |
| | Type II | 40 | 60 | 90 | 130 |

In this case, the twist pitches of the four insulated wire pairs 14A, 14B, 14C and 14D, that is, the twist pitches with which the twin-core insulated wires 16 of the wire pairs 14 were twisted together, were adjusted to 10 mm, 14 mm, 18 mm, and 22 mm, respectively, for Type I, and to 12 mm, 16 mm, 20 mm, and 24 mm, respectively, for Type II so that the twist pitches of the adjacent wire pairs 14 in each unit 12 and the twist pitches of the wire pairs 14 in the adjacent units 12 were different. Then, the units 12 of the two types, Types I and II, were arranged alternately, as shown in FIG. 5.

Under the conditions described above, eight units 12 were made by twisting together the four insulated wire pairs 14A to 14D in each unit 12 with four combinations of twist pitches, 30 mm and 40 mm (example 1), 50 mm and 60 mm (example 2), 70 mm and 90 mm (example 3), and 110 mm and 130 mm (example 4), for Types I and II, respectively. The units 12 were constructed by alternately twisting a plurality of insulated wire pairs 14 so that the wire pairs in each two adjacent units 12 had different twist pitches, whereupon four experimental examples were prepared. In any of these examples, the six units 12 were cabled with a twist pitch of 210 mm, as shown in Table 2.

Then, near-end crosstalk attenuations were measured for all combinations of insulated wire pairs 14 in the adjacent units 12 (Types I and II of Tables 2 and 3) in the four experimental examples shown in Tables 2 and 3.

The near-end crosstalk attenuations thus obtained for the individual experimental examples were evaluated with reference to Table 4 which shows the standard specifications (Category 5) for electric wires for high-speed data communication of 100 Mbps provided by the EIA/TIA.

TABLE 4

| Frequency (MHz) | Standard values (dB) 305 or more) |
|---|---|
| 0.150 | 74 |
| 0.772 | 64 |

TABLE 4-continued

| Frequency (MHz) | Standard values (dB) 305 or more) |
|---|---|
| 1.0 | 62 |
| 4.0 | 53 |
| 8.0 | 48 |
| 10.0 | 47 |
| 16.0 | 44 |
| 20.0 | 42 |
| 25.0 | 41 |
| 31.25 | 40 |
| 62.5 | 35 |
| 100.0 | 32 |

In evaluation, the sums of the standard values shown in Table 4 and 11 dB were subtracted from the measured values of the near-end crosstalk attenuations obtained for all combinations of four insulated wire pairs (1) to (4) which constitute the units 12 of Type I shown in Table 2 and another four insulated wire pairs (5) to (8) which constitute the units 12 of Type II (e.g., combinations of insulated wire pairs (1) and (5), (1) and (6), (1) and (7), (1) and (8), etc.), and the resulting values for the individual combinations were obtained for all frequency bands (12 frequencies shown in Table 4) of the standard specifications shown in Table 4.

The problem is whether or not the sums of the standard values shown in Table 4 and 11 dB can be covered in the worst case. Therefore, minimum values of 12 near-end crosstalk attenuations obtained for all frequency bands were regarded as crosstalk levels for the individual combinations of insulated wire pairs 14.

In this case, the sums of the standard values shown in Table 4 and 11 dB were used as criteria for the evaluation because the value 11 dB is a proper margin to make up for multiplex crosstalk. More specifically, the value 11 dB was calculated by substituting n=2 for [standard value+{6+10log (n+1)} dB], a proposal of the aforementioned ISO/IEC, that is, according to 6+10log(2+1)=10.77=11. In this case, the variable n is the number of units 12 adjoined by each unit 12. In the communication cable 10 specified by Table 2, the one unit 12A adjoins the two units 12B and 12F, as shown in FIG. 1, so that n=2 is given. Thus, for example, in the case where a unit 12 is used in place of the filler 34, in contrast with the case of FIG. 1, the number of units 12 adjoined by each unit 12 is 3, so that n=3 is given.

Figure 7:
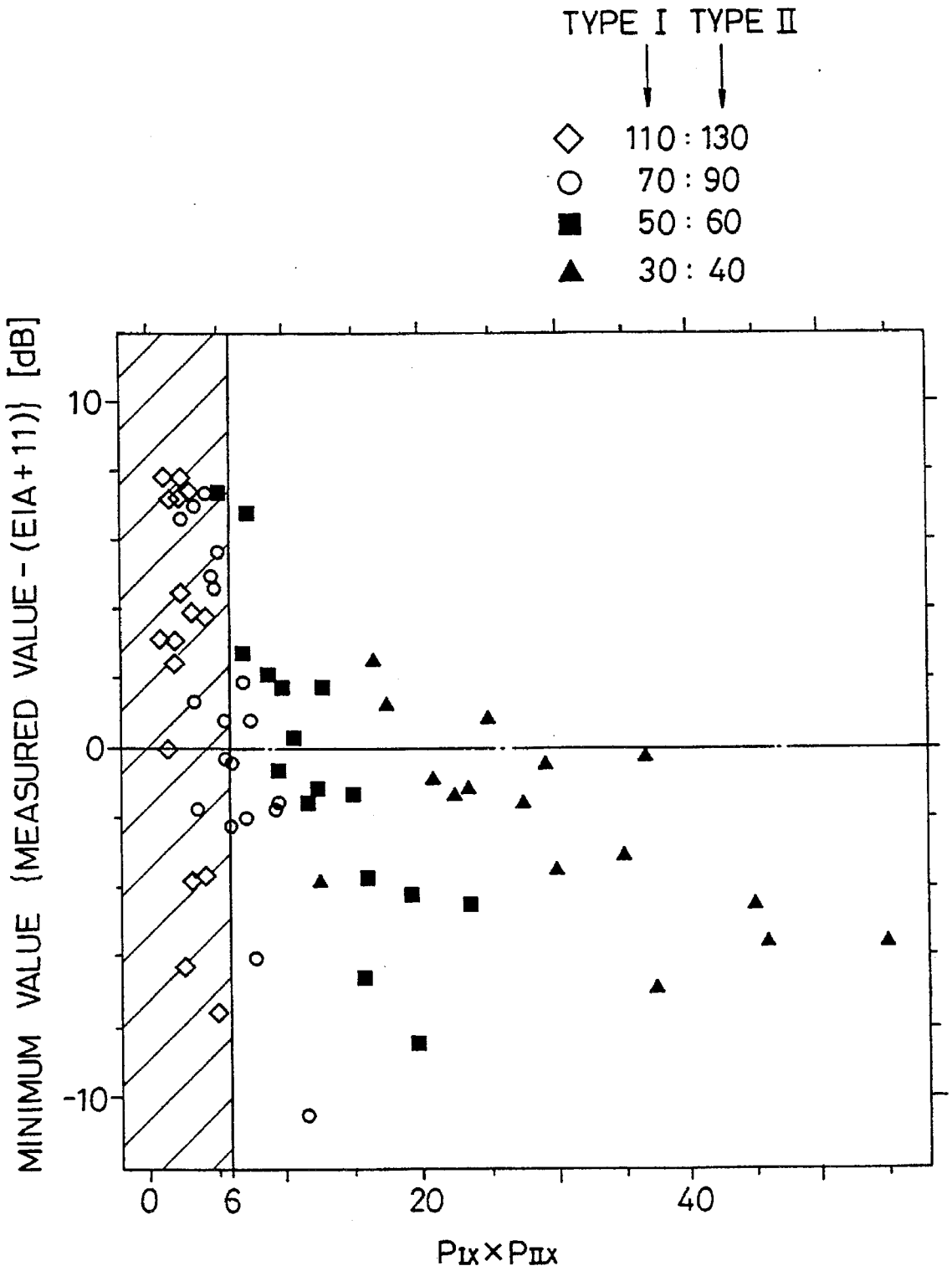
FIG. 7 is a plot diagram showing the relationship between near-end-crosstalk attenuations, obtained for all combinations of insulated wire pairs in adjacent units according to Examples 1 to 4 shown in Tables 2 and 3, and the product ($P_{Ix} \times P_{IIx}$) of the unit diametrical components of the twist pitches of insulated wire pairs which constitute units of Types I and II, individually.
Figure 8:
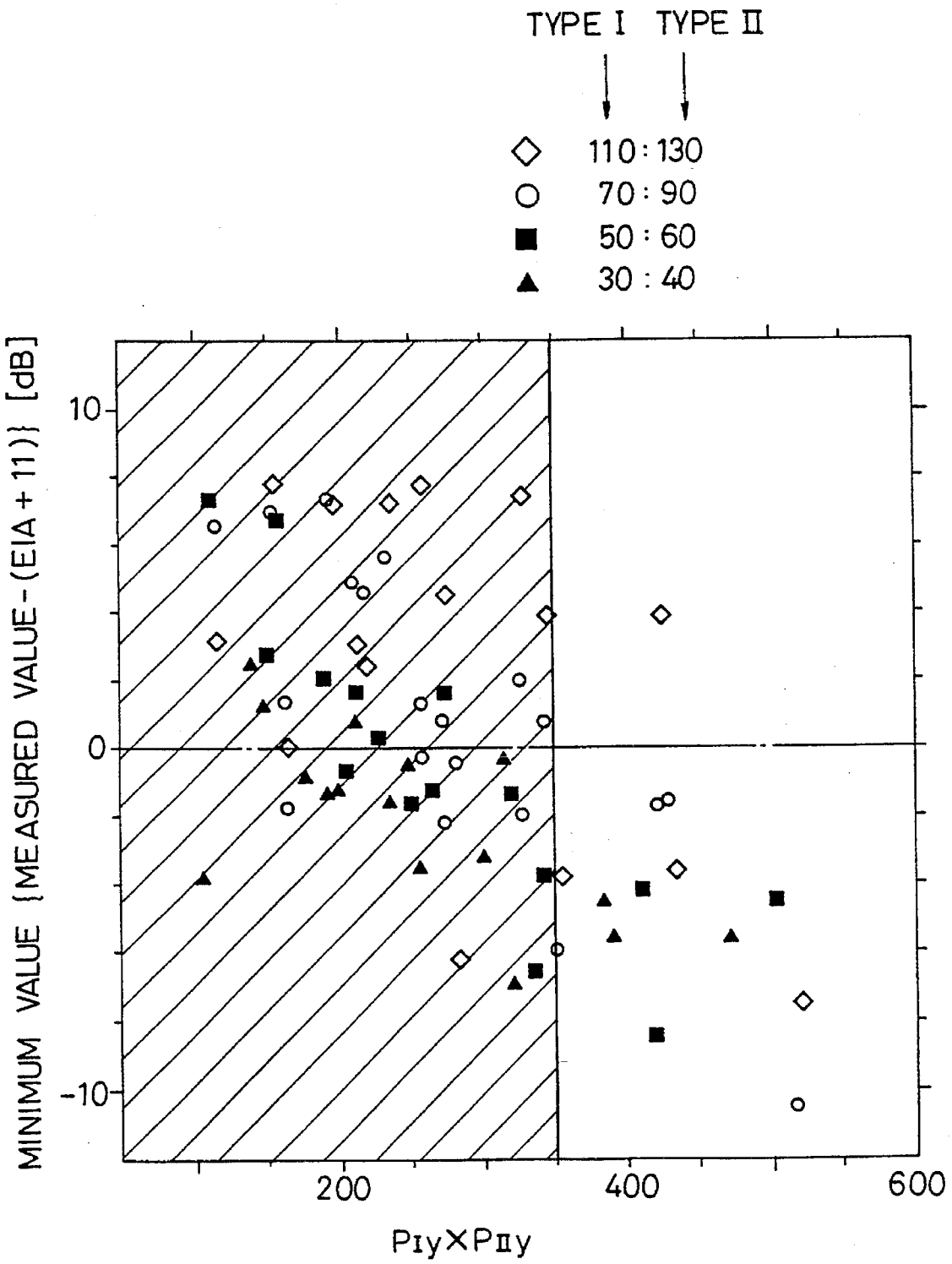
FIG. 8 is a plot diagram showing the relationship between the near-end crosstalk attenuations, obtained for all the combinations of insulated wire pairs in the adjacent units according to Examples 1 to 4 shown in Tables 2 and 3, and the product ($P_{Iy} \times P_{IIy}$) of the unit lengthwise components of the twist pitches of the insulated wire pairs which constitute the units of Types I and II, individually.
Figure 9:
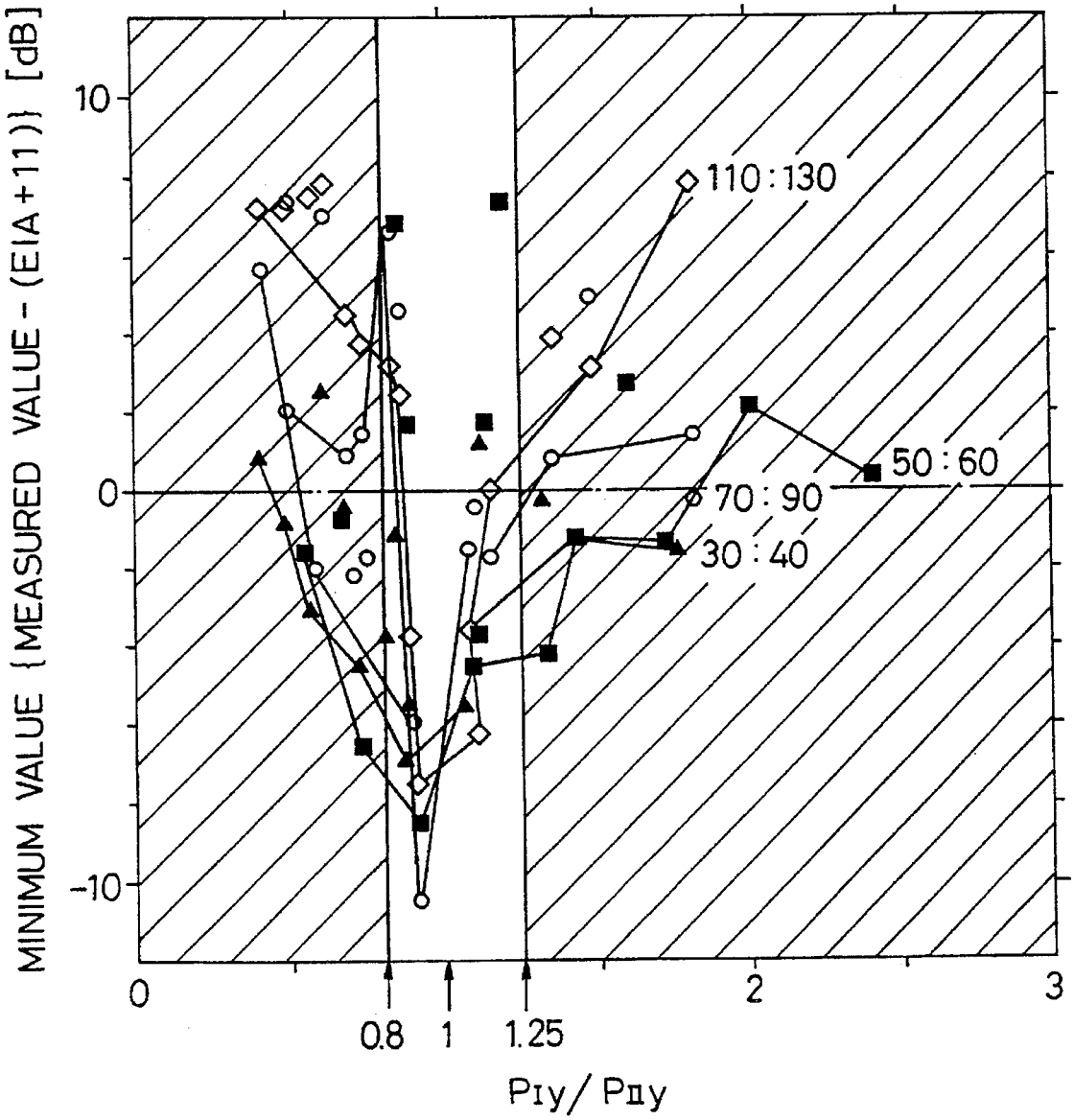
FIG. 9 is a plot diagram showing the relationship between the near-end crosstalk attenuations, obtained for all the combinations of insulated wire pairs in the adjacent units according to Examples 1 to 4 shown in Tables 2 and 3, and the ratio ($P_{Iy}/P_{IIy}$) between the unit lengthwise components of the twist pitches of the insulated wire pairs which constitute the units of Types I and II, individually.

FIGS. 7 to 9 show the results of evaluations based on various experiments conducted in the manner described above.

In evaluating crosstalk levels, obtained as the result of the experiments, in connection with the combinations of twist pitches of the insulated wire pairs 14, each twist pitch P of each insulated wire pair 14, which extends obliquely twisted in the unit 12, was supposed to be reduced to two components, a unit diametrical component ($P_{ix}$ or $P_{jx}$ of FIG. 4) and a unit lengthwise component ($P_{iy}$ or $P_{jy}$ of FIG. 4), as shown in FIG. 4.

In the experimental examples shown in Table 2, various evaluations were made on the assumption that the twist pitch of an insulated wire pair $T_I$ which constitutes a unit $U_I$ of Type I, out of adjacent units 12 of Types I and II, is $P_I$, the twist pitch of an insulated wire pair $T_{II}$ which constitutes a unit $U_{II}$ of Type II is $P_{II}$, the twist pitch $P_I$ of the wire pair $T_I$ is reduced to a unit diametrical component $P_{Ix}$ and a unit lengthwise component $P_{Iy}$, and the twist pitch $P_{II}$ of the wire pair $T_{II}$ is reduced to a unit diametrical component $P_{IIx}$ and a unit lengthwise component $P_{IIy}$.

FIG. 7 shows the results of evaluations of the near-end crosstalk attenuations for the combinations of insulated wire pairs 14 according to the individual experimental examples. In the diagram of FIG. 7, the axis of abscissa represents the product ($P_{Ix}\times P_{IIx}$) of the unit diametrical component $P_{Ix}$ of the twist pitch $P_I$ of the insulated wire pair $T_I$, which constitutes the unit $U_I$ of Type I, and the unit diametrical component $P_{IIx}$ of the twist pitch $P_{II}$ of the insulated wire pair $T_{II}$, which constitutes the unit $U_{II}$ of Type II, while the axis of ordinate represents the minimum value of difference in all frequency bands obtained by subtracting the sum of each standard value shown in Table 4 and 11 dB from the measured value of the near-end crosstalk attenuation obtained for each combination of insulated wire pairs 14.

Thus, when the ordinate value is 0 dB in FIG. 7, there is no difference between the measured value and the sum of the standard value and 11 dB, that is, measured value=standard value+11 dB is given. Thus, the criterion, standard value+11 dB, is met. In this case, moreover, each plot in FIG. 7 represents the minimum of the near-end crosstalk attenuations obtained in all frequency bands for each combination of insulated wire pairs 14. If the plot corresponds to a value not smaller than 0 dB with respect to the ordinate axis, therefore, then the criterion, standard value+11 dB, will be also met in any other frequency band for the combination of insulated wire pairs 14 concerned.

It was found that some combinations of insulated wire pairs 14 which can meet the criterion, standard value+11 dB, can be secured in the hatched region of FIG. 7 given by $P_{Ix}\times P_{IIx}\leqq 6$. Thereupon, in order to condition these combinations with respect to the outside diameter d of the insulated wires 16 which constitute each insulated wire pair 14, expression (1) $P_{Ix}\times P_{IIx}/d^2\leqq 7$ (equivalent to $P_{ix}\times P_{jx}/d^2\leqq 7$), was obtained by dividing $P_{Ix}\times P_{IIx}\leqq 6$ ($P_{ix}\times P_{jx}\leqq 6$ if the twist pitches of the optionally selected insulated wire pairs $T_i$ and $T_j$ are $P_i$ and $P_j$, respectively) by the square of the outside diameter d of the insulated wires 16 which constitute each insulated wire pair 14.

The combinations indicated in the hatched region shown in FIG. 7 also include combinations of those insulated wire pairs 14 which correspond to ordinate values smaller than 0 dB (i.e., with the criterion, standard value+11 dB, not met). This is because the combinations of the twist pitches of the insulated wire pairs 14 in each experimental example shown in Table 2 do not always fulfill the other condition given by expression (2) or (3). Thus, FIG. 7 indicates that the criterion, standard value+11 dB, cannot be fully met by only fulfilling expression (1), and some other condition should be also taken into consideration.

FIG. 8 also shows the results of evaluations of the near-end crosstalk attenuations for the combinations of insulated wire pairs 14 according to the individual experimental examples. In the diagram of FIG. 8, the axis of abscissa represents the product ($P_{Iy}\times P_{IIy}$) of the unit lengthwise component $P_{Iy}$ of the twist pitch $P_I$ of the insulated wire pair $T_I$, which constitutes the unit $U_I$ of Type I, and the unit lengthwise component $P_{IIy}$ of the twist pitch $P_{II}$ of the insulated wire pair $T_{II}$, which constitutes the unit $U_{II}$ of Type II, while the axis of ordinate represents the minimum value of difference in all frequency bands obtained by subtracting the sum of each standard value shown in Table 4 and 11 dB from the measured value of the near-end crosstalk attenuation obtained for each combination of insulated wire pairs 14.

Thus, when the ordinate value is 0 dB in FIG. 8, there is no difference between the measured value and the sum of the standard value and 11 dB, that is, measured value=standard value+11 dB is given. Thus, the criterion, standard value+11 dB, is met. Also in FIG. 8, each plot repreSentS the minimum of the near-end crosstalk attenuations obtained in all frequency bands for each combination of insulated wire pairs 14. If the plot corresponds to a value not smaller than 0 dB with respect to the ordinate axis, therefore, then the criterion, standard value+11 dB, will be also met in any other frequency band for the combination of insulated wire pairs 14 concerned.

It was found that some combinations of insulated wire pairs 14 which can meet the criterion, standard value+11 dB, can be secured in the hatched region of FIG. 8 given by $P_{Iy} \times P_{IIy} \leqq 350$.

Thereupon, in order to condition these combinations with respect to the outside diameter d of the insulated wires 16 which constitute each insulated wire pair 14, the condition $P_{Iy} \times P_{IIy}/d^2 \leqq 413$ ($P_{iy} \times P_{jy}/d^2 \leqq 413$ if the twist pitches of the optionally selected insulated wire pairs $T_i$ and $T_j$ are $P_i$ and $P_j$, respectively) of expression (2) was obtained by dividing $P_{Iy} \times P_{IIy} \leqq 350$ ($P_{iy} \times P_{jy} \leqq 350$ if the twist pitches of the optionally selected insulated wire pairs $T_i$ and $T_j$ are $P_i$ and $P_j$, respectively) by the square of the outside diameter d (d=0.92 mm) of the insulated wires 16 which constitute each insulated wire pair 14.

The combinations indicated in the hatched region shown in FIG. 8 also include combinations of those insulated wire pairs 14 which correspond to ordinate values smaller than 0 dB (i.e., with the criterion, standard value+11 dB, not met). This is because the combinations of the twist pitches of the insulated wire pairs 14 in each experimental example shown in Table 2 do not always fulfill expression (1) and other requirements. Thus, FIG. 8 indicates that the criterion, standard value+11 dB, cannot be fully met by only fulfilling the expression $P_{iy} \times P_{jy}/d^2 \leqq 413$, one condition of expression (2), and expression (1) should be taken into consideration. Besides, it is indicated that further conditions should be groped for with the expression $P_{iy} \times P_{jy}/d^2 \leqq 413$ as a premise.

In general, near-end crosstalk is believed to depend on the ratio between the twist pitches of the insulated wire pairs 14. Accordingly, the relationship was examined between the near-end crosstalk attenuation and the ratio ($P_{Iy}/P_{IIy}$) between the unit lengthwise components $P_{Iy}$ and $P_{IIy}$ of the twist pitches $P_I$ and $P_{II}$ of the insulated wire pairs $T_I$ and $T_{II}$ which constitutes the units $U_I$ and $U_{II}$ of Types I and II, respectively.

FIG. 9 shows the results of evaluations of the near-end crosstalk attenuations for the combinations of insulated wire pairs 14 according to the individual experimental examples. In the diagram of FIG. 9, the axis of abscissa represents $P_{Iy}/P_{IIy}$, while the axis of ordinate, like those of FIGS. 7 and 8, represents the minimum value of difference in all frequency bands obtained by subtracting the sum of each standard value shown in Table 4 and 11 dB from the measured value of the near-end crosstalk attenuation obtained for each combination of insulated wire pairs 14. FIG. 9 also indicates that the criterion, standard value+11 dB, is met for the combinations of insulated wire pairs 14 concerned in any frequency band when the ordinate value is 0 dB or more.

Also, the abscissa axis of FIG. 9 represents $P_{Iy}/P_{IIy}$. Therefore, if the abscissa value is smaller than 1, then $P_{Iy}<P_{IIy}$ will be given. If the abscissa value is greater than 1, then $P_{Iy}>P_{IIy}$ will be given. All the twist pitches of the insulated wire pairs 14 are set so as to be different from one another, as shown in Table 2. Accordingly, $P_{Iy}/P_{IIy}=1$ cannot be obtained in the experimental examples shown in Table 2. Also in FIG. 9, there is no plot on the abscissa value corresponding to 1.

The hatched region of FIG. 9 indicates that the criterion, standard value+11 dB, can be met by selecting the twist pitches of the insulated wire pairs 14 from a region which fulfills $P_{Iy}/P_{IIy} \leqq 0.8$ ($P_{iy}/P_{jy} \leqq 0.8$ if the twist pitches of the optionally selected insulated wire pairs $T_i$ and $T_j$ are $P_i$ and $P_j$, respectively) with $P_{Iy}<P_{IIy}$ or a region which fulfills $P_{Iy}/P_{IIy} \geqq 1.25$ ($P_{iy}/P_{jy} \geqq 1.25$) with $P_{Iy}>P_{IIy}$.

Thus, it is believed that a satisfactory crosstalk characteristic can be obtained for the unit lengthwise component if the ratio between the twist pitches of the insulated wire pairs 14 is taken into consideration under the prior condition $P_{Iy} \times P_{IIy}/d^2 \leqq 413$ obtained from FIG. 8. In this manner, a region covered by the range of expression (2) was obtained such that $P_{iy}/P_{jy} \geqq 1.25$ is obtained if $P_{iy}>P_{jy}$ is given, and $P_{iy}/P_{jy} \leqq 0.8$ is obtained if $P_{iy}<P_{jy}$ is given.

Also in this case, the combinations of those insulated wire pairs 14 which correspond to ordinate values smaller than 0 dB are included because data shown in FIG. 9 do not always fulfill expression (1) and the other condition or the prior condition $P_{iy} \times P_{jy}/d^2 \leqq 413$ of expression (2).

Thus, FIG. 9 indicates that the criterion, standard value+11 dB, cannot be fully met by only fulfilling the region for "if $P_{iy}/P_{jy}$, then $P_{iy}/P_{jy} \geqq 1.25$; if $P_{iy}<P_{jy}$, then $P_{iy}/P_{jy} \leqq 0.8$," this condition must be fulfilled under the prior condition "if $P_{iy} \times P_{jy}/d^2 \leqq 413$," and some other condition should be also taken into consideration.

Also, FIG. 9 shows data indicated by plots corresponding to ordinate values of 0 dB or more, whereby the criterion, standard value+11 dB, is met, even in the range given by $0.8<P_{Iy} \times P_{IIy}<1.25$, that is, the range outside the ranges of the condition of expression (2). These data correspond to combinations of short twist pitches, among other twist pitches of the insulated wire pairs 14 variously set for Examples 1 to 4.

Thus, in the case where the value $P_{Iy} \times P_{IIy}$ is rather small, the existence of some combinations of insulated wire pairs 14 which can meet the criterion, standard value+11 dB, in the region where the ratio ($P_{Iy}/P_{IIy}$) between the unit lengthwise components of the twist pitches of the wire pairs 14 is nearly 1 can be estimated from the condition "if $P_{Iy}>P_{IIy}$, then $P_{Iy}/P_{IIy} \geqq 1.25$; if $P_{Iy}<P_{IIy}$, then $P_{Iy}/P_{IIy} \leqq 0.8$" of expression (2).

Thereupon, further experiments (Examples 5 and 6) were conducted in order to examine those regions in which the criterion, standard value+11 dB, can be met. Example 5 is a case in which the twist pitch $P_{II}$ of the insulated wire pair $T_{II}$ which constitutes the unit $U_{II}$ of Type II was adjusted to $P_{II}$=8.5 mm. Example 6 is a case in which the insulated wire pairs $T_I$ and $T_{II}$, whose twist pitches $P_I$ and $P_{II}$ are both 10.0 mm or more, were combined.

Figure 10:
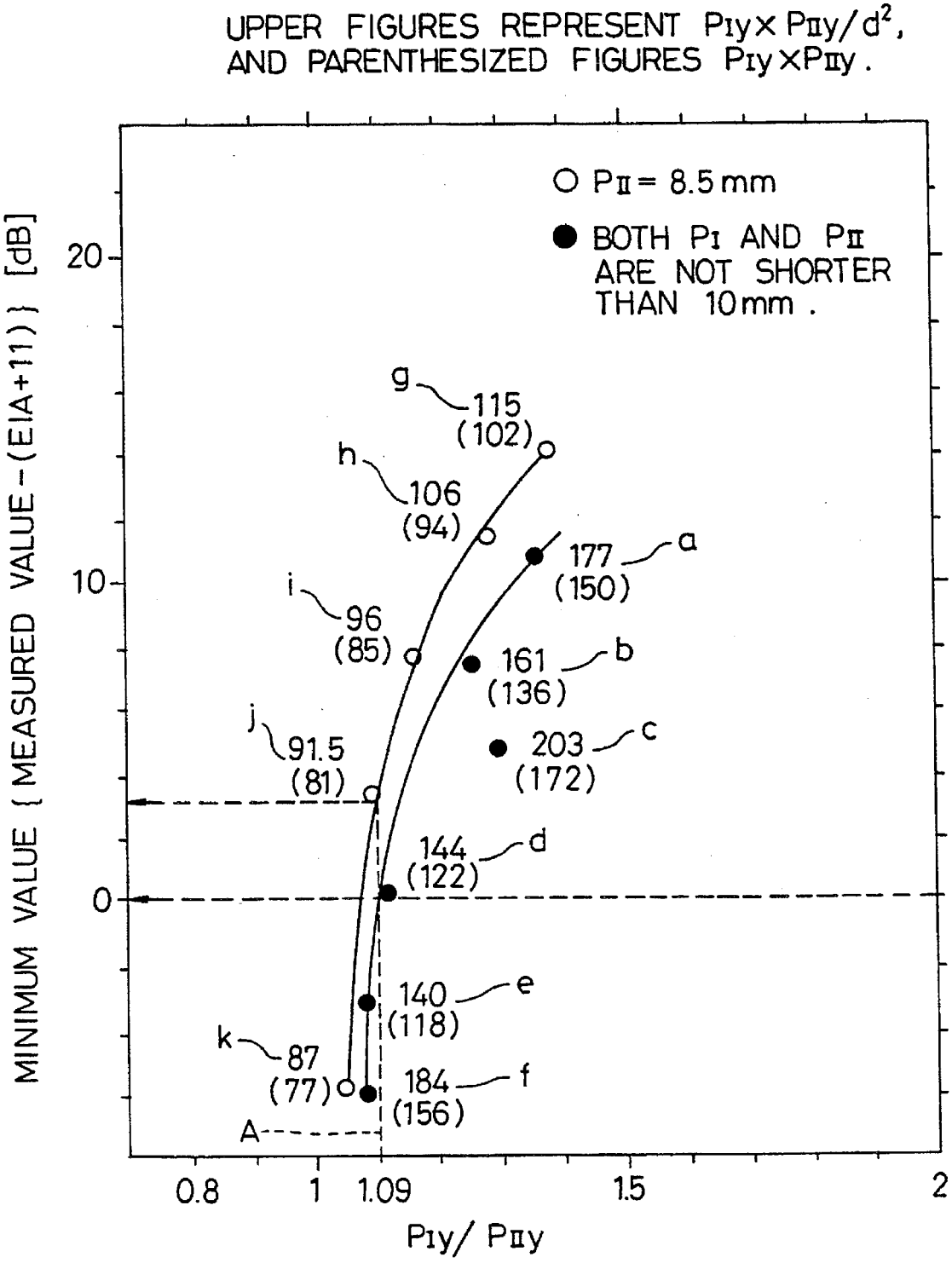
FIG. 10 is a plot diagram showing the relationship between the near-end crosstalk attenuations, obtained with the product ($P_{Iy} \times P_{IIy}$) of the unit lengthwise components of the twist pitches of the insulated wire pairs varied, for a case (Example 5) in which a twist pitch $P_I$ of an insulated wire pair $T_I$ which constitutes a unit of Type I on the transmission side is fixed to 8.5 mm and for a wire pair combination (Example 6) in which both the twist pitch $P_I$ of the insulated wire pair $T_I$ and a twist pitch $P_{II}$ of an $T_{II}$ are 10.0 mm or more, and the ratio ($P_{Iy}/P_{IIy}$) between the unit lengthwise components of the twist pitches of the insulated wire pairs which constitute the units of Types I and II, individually.

In the combination of insulated wire pair $T_I$ and the insulated wire pair $T_{II}$ which constitutes the unit $U_{II}$ of Type II, the value $P_{Iy} \times P_{IIy}$ is set variously by changing the twist pitch $P_{II}$ ($P_{IIy}$ for the unit lengthwise component) of the wire pair $T_{II}$. In FIG. 10, the axis of abscissa represents the ratio ($P_{Iy}/P_{IIy}$) between the unit lengthwise components of the twist pitches of the insulated wire pairs 14 in two units 12 (unit $U_I$ of Type I and unit $U_{II}$ of Type II) for each case, while the axis of ordinate represents the minimum value of difference in all frequency bands obtained by subtracting the sum of each standard value shown in Table 4 and 11 dB from the measured value of the near-end crosstalk attenuation obtained for each combination (combination of $T_I$ and $T_{II}$) of insulated wire pairs 14. The relationship was examined between the near-end crosstalk attenuation and the ratio ($P_{Iy}/P_{IIy}$) between the unit lengthwise components of the twist pitches of the insulated wire pairs 14 for each case.

In the case where $P_{Iy}>P_{IIy}$ is given, that is, where the abscissa value is greater than 1, as shown in FIG. 10, the border line of the ratio ($P_{Iy}/P_{IIy}$) between the unit lengthwise components of twist pitches such that all the ordinate values are 0 dB or more (i.e., the criterion, standard value+11 dB, is met) is obtained. Thereupon, it was found that the criterion, standard value+11 dB, can be met within the range $P_{Iy}/P_{IIy}\geqq 1.09$, as indicated by broken line A in FIG. 10.

Thus, in the case where $P_{Iy}>P_{IIy}$ ($P_{iy}>P_{jy}$ if the twist pitches of the optionally selected insulated wire pairs $T_i$ and $T_j$ are $P_i$ and $P_j$, respectively) is given, as shown in FIG. 10, the ordinate values are smaller than 0 dB and cannot meet the criterion, standard value+11 dB, within the range $P_{Iy}/P_{IIy}<1.09$ (see plots e, f and k of FIG. 10). It can be seen, on the other hand, that the criterion, standard value+11 dB, is met within the range $P_{Iy}/P_{IIy}\geqq 1.09$ ($P_{iy}/P_{jy}\geqq 1.09$) (plots a to d and g to j of FIG. 10).

In connection with the respective twist pitches $P_I$ and $P_{II}$ of the insulated wire pairs $T_I$ and $T_{II}$, the measured near-end crosstalk attenuation value obtained in the case where the insulated wire pairs $T_I$ and $T_{II}$ are used as inducing-side (transmission-side) and induced-side (receptionsside) wire pairs 14, respectively, is equal to the value obtained in the case where the wire pairs $T_I$ and $T_{II}$ are used as induced-side (reception-side) and inducing-side (transmission-side) wire pairs 14, respectively.

In the case where $P_{Iy}>P_{IIy}$ is given, the criterion, standard value+11 dB, is met if $P_{Iy}/P_{IIy}\geqq 1.09$ is fulfilled. In the case where $P_{Iy}<P_{IIy}$ ($P_{iy}<P_{jy}$ if the twist pitches of the optionally selected insulated wire pairs $T_i$ and $T_j$ are $P_i$ and $P_j$, respectively) is given, therefore, the criterion, standard value+11 dB, can be supposed to be met within the range $P_{Iy}/P_{IIy}\leqq 0.92$ ($P_{iy}/P_{jy}\leqq 0.92$), 0.92 being the reciprocal of the ratio 1.09.

In order to maximize the range which can meet the criterion, standard value+11 dB, in this case, it is necessary in the worst case only that the criterion, standard value+11 dB, be met in the case where the ratio ($P_{Iy}/P_{IIy}$) between the unit lengthwise components of the twist pitches takes a minimum value (i.e., 1.09) within the range $P_{Iy}/P_{IIy}\geqq 1.09$. Accordingly, consideration should be given to the point of intersection between a line on the ordinate value 0 dB and a line on the abscissa value 1.09 such that the near-end crosstalk attenuation value is the lowest (i.e., the ordinate value is approximate to 0 dB) within the range not lower than the criterion, standard value+11 dB.

Referring to FIG. 10, the plot d for $P_{Iy}\times P_{IIy}/d^2=144$ was found to be data which corresponds between the line on the ordinate value 0 dB and the line on the abscissa value 1.09. Within the range $P_{Iy}\times P_{IIy}/d^2\leqq 144$ ($P_{iy}\times P_{jy}/d^2\leqq 144$ if the twist pitches of the optionally selected insulated wire pairs $T_i$ and $T_j$ are $P_i$ and $P_j$, respectively), therefore, it is indicated that the criterion, standard value+11 dB, can be met to obtain a satisfactory crosstalk characteristic if the condition "if $P_{Iy}>P_{IIy}$, then $P_{Iy}/P_{IIy}\geqq 1.09$; if $P_{Iy}<P_{IIy}$, then $P_{Iy}/P_{IIy}\leqq 0.92$" is fulfilled.

In this manner, expression (3), which is indicative of "if $P_{iy}>P_{jy}$, then $P_{iy}/P_{jy}\geqq 1.09$; if $P_{iy}<P_{jy}$, then $P_{iy}/P_{jy}\leqq 0.92$, where $P_{iy}\times P_{jy}/d^2\leqq 144$," was obtained. In this case, moreover, the combinations of insulated wire pairs 14 which can meet the criterion,-standard value+11 dB, can be covered more widely if the condition of expression (3) is used within the range $P_{iy}\times P_{jy}/d^2\leqq 144$. Thus, the prior condition "if $144<P_{iy}\times P_{jy}/d^2\leqq 413$" of expression (2) was obtained by removing the region for "$P_{iy}\times P_{jy}/d^2\leqq 144$" from the range "$P_{iy}\times P_{jy}/d^2\leqq 413$" obtained as the prior condition of expression (2).

This is also indicated by the fact that there are more plots which correspond to ordinate values of 0 dB or more so that the criterion, standard value+11 dB, is met, in Example 5 (see plots in the form of circles in FIG. 10), in which the relatively short twist pitch of $P_I=8.5$ is set so that $P_{Iy}\times P_{IIy}$ is relatively small, than in Example 6 (see plots in the form of solid spots in FIG. 10), within the range $P_{Iy}\times P_{IIy}/d^2\leqq 144$ in FIG. 10. Thus, only the one plot d is obtained in Example 6, and four plots g, h, i and j in Example 5.

In consideration of these circumstances, FIG. 10 also shows plots (plots a, b and c) which are obtained in the case where the value $P_{Iy}\times P_{IIy}/d^2$ exceeds 144 so that the condition "$P_{Iy}\times P_{IIy}/d^2\leqq 144$" is not fulfilled, among those plots (plots a to d and g to j) which correspond to ordinate values of 0 dB or more so that the criterion, standard value+11 dB, is met.

Thus, FIG. 10 contains those plots which meet the criterion, standard value+11 dB, although the prior condition of expression (3) is not fulfilled. As shown in FIG. 10, the value $P_{Iy}\times P_{IIy}/d^2$ is 177 for the plot a, 161 for plot b, and 203 for plot c, so that the condition "if $P_{Iy}\times P_{IIy}/d^2\leqq 144$" of expression (3) is not fulfilled. Since the prior condition "if $144<P_{Iy}\times P_{IIy}/d^2\leqq 413$" of expression (2) is fulfilled and that the value $P_{Iy}\times P_{IIy}$ is 1.25 or more for any of the plots a, b and c, however, the condition "if $P_{Iy}>P_{IIy}$, then $P_{Iy}/P_{IIy}\geqq 1.25$" of expression (2) is fulfilled, so that the plots need not be covered by the ranges of expression (3).

On the other hand, the value $P_{Iy}\times P_{IIy}/d^2$ is 144 or less for any of the other plots (plots d, g, h, i and j) which correspond to ordinate values of 0 dB or more so that the criterion, standard value+11 dB, is met, as shown in FIG. 10. Accordingly, the condition "$P_{Iy}\times P_{IIy}/d^2\leqq 144$" of expression (3) is fulfilled, and the value $P_{Iy}/P_{IIy}$ is 1.09 or more for any of the plots, so that the condition "if $P_{Iy}>P_{IIy}$, then $P_{Iy}/P_{IIy}\geqq 1.09$" of expression (3) is fulfilled.

In these cases, therefore, it is indicated that the criterion, standard value+11 dB, is met by fulfilling the condition of expression (3). It is indicated, in particular, that those plots (plots d, i and j of FIG. 10) which can meet the criterion, standard value+11 dB, can be covered according to expression (3) even in the region for $1.09\leqq P_{Iy}/P_{IIy}<1.25$, that is, the region in which the condition "if $P_{Iy}>P_{IIy}$, then $P_{Iy}/P_{IIy}\geqq 1.25$, where $P_{Iy}\times P_{IIy}/d^2\leqq 4.13$," part of expression (2) is not fulfilled.

The plots e, f and k, among the other plots shown in FIG. 10, correspond to ordinate values of 0 dB or less, so that they do not meet the criterion, standard value+11 dB. This is because the plots e and k do not fulfill the condition "if $P_{Iy}>P_{IIy}$, then $P_{Iy}/P_{IIy}\geqq 1.09$" of expression (3), although they fulfill the prior condition "$P_{Iy}\times P_{IIy}/d^2\leqq 144$" of expression (3), since the value $P_{Iy}/P_{IIy}$ is smaller than 1.09. As for the plot f, it does not fulfill the condition "if $P_{Iy}>P_{IIy}$, then $P_{Iy}/P_{IIy}\geqq 1.25$" of expression (2), although they fulfill the condition "$144<P_{Iy}\times P_{IIy}/d^2\leqq 413$" of expression (2) since the value $P_{Iy}/P_{IIy}$ is also smaller than 1.25. This substantiates the fact that the criterion, standard value+11 dB, cannot be met unless expression (2) or (3) is fulfilled.

Thus, it is indicated that any of those plots which correspond to ordinate values of 0 dB or more so that the criterion, standard value+11 dB, is met, among the other plots shown in FIG. 10, meets the criterion, standard value+11 dB, by fulfilling either expression (2) or (3) which is obtained according to the present invention.

At the same time, the ranges of application of expressions (2) and (3), which are two expressions obtained with respect to the unit lengthwise components of the twist pitches, are categorized depending on whether $P_{iy}P_{jy}/d^2$ for a certain combination of insulated wire pairs 14 exceeds 144 or not. It is evident, therefore, that the expressions (2) and (3) cannot hold at the same time for one combination of insulated wire pairs 14. Thus, expression (2) or (3) is selected for each combination of insulated wire pairs 14, depending on the type of the optionally selected combination of wire pairs 14 (value $P_{iy} \times P_{jy}$ for the combination of wire pairs 14) in one communication cable 10.

In some cases, one communication cable 10 may mixedly incorporate combinations of insulated wire pairs 14 which fulfill expressions (1) and (2) and combinations of insulated wire pairs 14 which fulfill expressions (1) and (3). Thus, the present invention is not limited in application to a communication cable 10 which include only the combinations of insulated wire pairs 14 which fulfill expressions (1) and (2) or a communication cable 10 which include only the combinations of insulated wire pairs 14 which fulfill expressions (1) and (3).

It is to be understood, however, that if all combinations of a plurality of insulated wire pairs 14 which constitute each two adjacent units 12, among other insulated wire pairs 14 which constitute a certain communication cable 10, are in compliance with "$144 < P_{iy}P_{jy}/d^2 \leqq 413$," for example, only expressions (1) and (2) are applied to this cable 10.

Expressions (1) to (3) established for the relationship between the respective twist pitches of the insulated wire pairs 14 in each two adjacent units 12 are obtained as mentioned above. As seen from FIGS. 7 to 10, the criterion, standard value+11 dB, shown in Table 4 cannot be met unless the twist pitches $P_i$ and $P_j$ of the insulated wire pairs 14 are selected with ($P_{ix}$, $P_{iy}$) and ($P_{jx}$, $P_{jy}$) defined so that expressions (1) and (2) are fulfilled under the condition "if $144 < P_{iy} \times P_{jy}/d^2 \leqq 413$," and that expressions (1) and (3) are fulfilled under the condition "if $P_{iy} \times P_{jy}/d_2 \leqq 144$."

The following is a description of the processes of obtaining expression (4) which is established for the relationship between the respective twist pitches of the insulated wire pairs 14 in each two alternate units 12.

assumption that expressions (1) to (3) are fulfilled, experiments were conducted in order to examine the values of twist pitches of the insulated wire pairs 14 which can provide a satisfactory crosstalk characteristic in each unit 12, between each two adjacent units 12, and between each two alternate units 12 (Examples 7 and Table 5 shows details of Examples 7 and 8.

In Examples 7 and 8, each of 24 pairs of communication cables 10 was manufactured by cabling six units 12 (outside diameter: 3.85 mm) around the filler 34, as shown in FIG. 1. Each unit 12 included four insulated wire pairs 14 each composed of insulated wires 16 which were each formed by covering a conductor (annealed copper wire) having an outside diameter of 0.511 mm with an insulating layer (low-density polyethylene) having an outside diameter of 0.94 mm, as shown in Table 5.

First, in Example 7, the twist pitches of the four insulated wire pairs 14A, 14B, 14C and 14D, that is, the twist pitches with which the twin-core insulated wires 16 of the wire pairs 14 were twisted together, were adjusted to 9.0 mm, 10.0 mm, 11.0 mm, and 12.0 mm, respectively, for Type I, and to 8.2 mm, 17.0 mm, 20.0 mm, and 24.0 mm, respectively, for Type II so that expressions (1) and (2) or expressions (1) and (3) should be fulfilled, and that the twist pitches of the four wire pairs 14 in each unit 12 and the twist pitches of the wire pairs 14 in each two adjacent units 12 were all different. Then, the units 12 of Types I and II were arranged alternately, as shown in FIG. 5.

In this case, as shown in Table 5, the four insulated wire pairs 14A to 14D (insulated wire pairs (1) to (4) of Type I and insulated wire pairs (5) to (8) of Type II shown in Table 5) in each unit 12 were twisted with two twist pitches (twist pitches of the units 12), 140 mm for Type I and 160 mm for Type II, to form each unit 12. Thus, each unit was constructed by twisting together the four insulated wire pairs 14A to 14D with a twist pitch different from that of its adjacent unit 12.

TABLE 5

| | | | | Example 7 | | Example 8 | |
|---|---|---|---|---|---|---|---|
| Conductor | Material | | | Annealed copper wire | | | |
| | Outside diameter (mm) | | | 0.511 | | | |
| Insulating layer | Material | | | Low-Density polyethylene | | | |
| | Outside diameter (mm) | | | 0.94 | | | |
| Pair twisting (twisitng of twin-core insulated wires) | Pitch (mm) | Type I | (1) | 9.0 | left-hand | 9.0 | left-hand |
| | | | (2) | 10.0 | " | 10.0 | " |
| | | | (3) | 11.0 | " | 11.0 | " |
| | | | (4) | 12.0 | " | 12.0 | " |
| | | Type II | (5) | 8.2 | left-hand | 16.0 | left-hand |
| | | | (6) | 17.0 | " | 19.0 | " |
| | | | (7) | 20.0 | " | 23.0 | " |
| | | | (8) | 24.0 | " | 28.0 | " |
| Unit twisting (twisting of four pairs) | Pitch (mm) | Type I | | 140 | right-hand | 140 | right-hand |
| | | Type II | | 160 | " | 160 | " |
| Cabling (twisting of six units) | Method | | | Alternate arrangement of units of Types I and II | | | |
| | Pitch | | | 210 mm | | | |
| Binding tape | Method | | | Plastic tape wrapping | | | |
| Jacket | Material | | | PVC resin | | | |

More specifically, various twist pitches were set such that the twist pitches of a plurality of insulated wire pairs 14 which constitute the aforesaid two adjacent units 12 fulfill expressions (1) and (2) or expressions (1) and (3). On the All the six units 12 were cabled with the pitch of 210 mm in a manner such that all the insulated wire pairs 14 were twisted left-handed and all the units 12 right-handed, as shown in Table 5.

In selecting the twist pitches of the insulated wire pairs (1) to (8) according to Example 7, they were set so that the twist pitches of the insulated wire pairs 14 of Type I were different from or generally longer than those of the wire pairs 14 of Type II (see Table 5).

Further, the crosstalk characteristic is improved if several insulated wire pairs 14 having twist pitches shorter than those of a plurality of insulated wire pairs 14 which constitute one unit 12, out of each two adjacent units 12, are arranged in the other unit 12. As shown in Table 5, therefore, only one insulated wire pair (5) having a twist pitch shorter than those of four insulated wire pairs (1) to (4) which constitute a unit 12 of Type I was arranged in a unit 12 of Type II.

If the respective twist pitches of three or all of the four insulated wire pairs (5) to (8) which constitute the unit 12 of Type II are adjusted to small values such that they fulfill expression (3) when compared with the twist pitches of the insulated wire pairs (1) to (4) of the adjacent unit 12 of Type I, in this case, they are so short that the attenuation of electrical signals increases. According to Example 7, therefore, only the insulated wire pair (5) was adjusted to a short twist pitch, and all the twist pitches of the other insulated wire pairs (6) to (8) were set so as to be longer than those of the four insulated wire pairs (1) to (4) which constitute the unit 12 of Type I.

Then, near-end crosstalk attenuations were measured for all combinations of insulated wire pairs 14 in each unit 12 (Type I or II), in each two adjacent units 12 (Type I and Type II), in each two alternate units 12 (Type I and Type I; Type II and Type II), and in each two every-third units 12 (Type I and Type II) in Example 7 shown in Table 5.

In measurement, the sums of the standard values shown in Table 4 and 11 dB were subtracted from the measured values of the near-end crosstalk attenuations obtained for the individual combinations of the insulated wire pairs 14, and the resulting values for the individual combinations were obtained for all frequency bands of the standard specifications shown in Table 4. The problem is whether or not the sums of the standard values shown in Table 4 and 11 dB can be covered in the worst case. Therefore, minimum values of near-end crosstalk attenuations obtained for the individual frequency bands were regarded as crosstalk levels for the individual combinations of insulated wire pairs 14.

As a result, the worst of the near-end crosstalk attenuations throughout the frequency bands was able to meet the criterion, standard value+11 dB, provided by the EIA/TIA shown in Table 4, with respect to all combinations of the insulated wire pairs 14 in each unit 12, in each two adjacent units 12, and in each two every-third units 12. This is attributable to the fact that the relation between the insulated wire pairs 14 in each two adjacent units 12, in particular, fulfills expressions (1) and (2) or expressions (1) and (3).

As for the combinations of the insulated wire pairs 14 in each two alternate units 12, however, there are 16 combinations between Type I and Type I, including combinations of insulated wire pairs (1) and (1), (1) and (2), (1) and (3), (1) and (4), etc., and also 16 combinations between Type II and Type II, including combinations of insulated wire pairs (5) and (5), (5) and (6), (5) and (7), (5) and .(8), etc.

With respect to these combinations of insulated wire pairs 14, no problems were aroused between the units 12 of Type I and Type I which are composed of the insulated wire pairs 14 with relatively short twist pitches.

In the units 12 of Type II and Type II, in particular, however, there were combinations of insulated wire pairs 14 which were not able to meet the criterion, standard value+11 dB, shown in Table 4. If units 12 of two types are arranged alternately, as in the case of Example 7 (see Table 5), each two alternate units 12 constitute a Type I-Type I or Type II-Type II unit combination with the same twist pitch configuration (see FIG. 5). Out of the 16 combinations of insulated wire pairs 14 in total, therefore, four are combinations of wire pairs 14 which have the same twist pitches.

Figure 11:
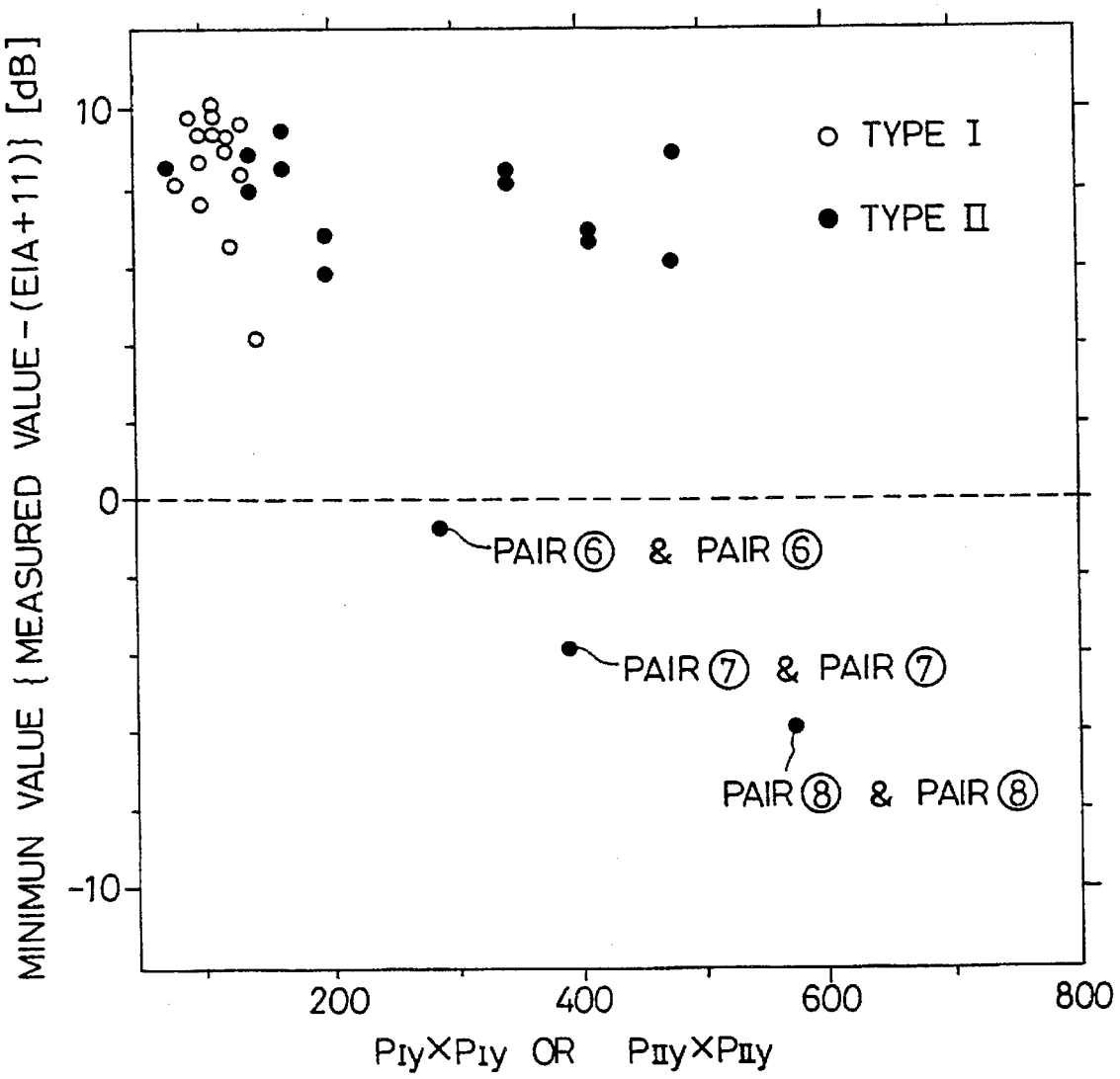
FIG. 11 is a plot diagram showing measured values of near-end crosstalk attenuations obtained for all combinations of insulated wire pairs in a unit of Type II according to Example 7 shown in Table 5.

FIG. 11 shows the results of evaluations of the near-end crosstalk attenuations for the combinations of insulated wire pairs 14. More specifically, in the diagram of FIG. 11, the axis of abscissa represents the product of the unit lengthwise components $P_{Iy}$ of the twist pitch $P_I$ of the insulated wire pair $T_I$, which constitutes the unit $U_I$ of Type I, and the product of the unit lengthwise components $P_{IIy}$ of the twist pitch $P_{II}$ of the insulated wire pair $T_{II}$, which constitutes the unit $U_{II}$ of Type II, while the axis of ordinate represents the minimum value of difference in all frequency bands obtained by subtracting the sum of each standard value shown in Table 4 and 11 dB from the measured value of the near-end crosstalk attenuation obtained for each combination of insulated wire pairs 14.

Figure 12:
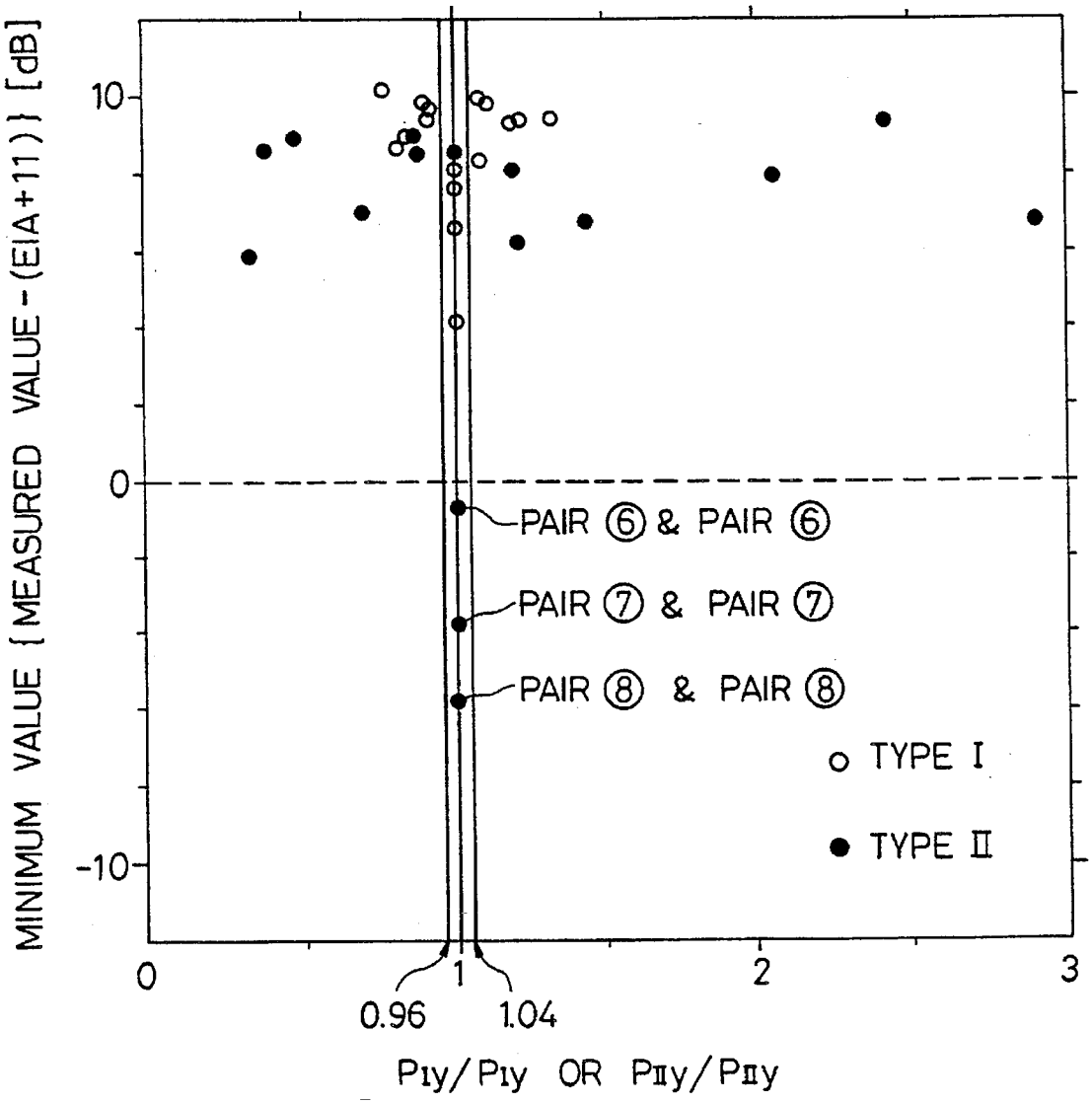
FIG. 12 is a plot diagram showing measured values of near-end crosstalk attenuations obtained for combinations of insulated wire pairs in two adjacent units (Types I and II) according to Example 7 shown in Table 5.

Also, FIG. 12 shows the results of evaluations of the near-end crosstalk attenuations for the combinations of insulated wire pairs 14. In the diagram of FIG. 12, the axis of abscissa represents the ratio between the unit lengthwise component $P_{Iy}$ of the twist pitch $P_I$ of the insulated wire pair $T_I$, which constitutes the unit $U_I$ of Type I, and the unit lengthwise component $P_{Iy}$ of the twist pitch $P_I$ of the insulated wire pair $T_I$, and the similar ratio for the unit $U_{II}$, while the axis of ordinate represents the minimum value of difference in all frequency bands obtained by subtracting the sum of each standard value shown in Table 4 and 11 dB from the measured value of the near-end crosstalk attenuation obtained for each combination of insulated wire pairs 14.

It was found that the criterion, standard value+11 dB, shown in Table 4 cannot be met with respect to the product ($P_{IIy} \times P_{IIy} > 200$) of the unit lengthwise components $P_{IIy}$ ($P_{IIy}/P_{IIy}=1$) of the insulated wire pairs 14 having the same twist pitch, combinations of the insulated wire pairs (6) and (6), (7) and (7), and (8) and (8), among the combinations of insulated wire pairs 14 in the units 12 of Type II and Type II indicated by plots in the form of solid spots, as shown in FIGS. 11 and 12.

On the other hand, the criterion, standard value +11 dB, shown in Table 4 was able to be fully met with respect to combinations of insulated wire pairs 14 in units 12 of Type I and Type I (indicated by plots in the form of circles in FIGS. 11 and 12), which are composed of insulated wire pairs (1) to (4) having relatively small twist pitches. As seen from FIG. 12, in particular, the criterion, standard value +11 dB, shown in Table 4 was able to be fully met with respect the combinations of insulated wire pairs 14 having the same twist pitches ($P_{Iy}/P_{Iy}=1$), that is, combinations of the insulated wire pairs (1) and (1), (2) and (2), (3) and (3), (4) and (4), and (5) and (5).

As seen from FIG. 12, moreover, the criterion, standard value+11 dB, shown in Table 4 was able to be fully met even with respect to combinations of insulated wire pairs 14 (e.g., combination of wire pairs (5) and (5)) having the same twist pitches in the units 12 of Type II and Type II, as long as the twist pitches were short.

Thus, it is indicated that a satisfactory crosstalk characteristic can be obtained even for the combinations of insulated wire pairs 14 having the same twist pitches, in each two alternate units 12, provided that the twist pitches are relatively short.

FIG. 12 indicates that a satisfactory crosstalk characteristic can be obtained for each two alternate units 12 by selecting the twist pitches of the insulated wire pairs 14 from a region such that the ratio between the unit lengthwise components of the twist pitches of the insulated wire pairs 14 is given by $P_{Iy}/P_{Iy}\geqq 1.04$ and $P_{IIy}/P_{IIy}\geqq 1.04$ in the case where the abscissa value is greater than 1 so that there are relations $P_{Iy}>P_{Iy}$ and $P_{IIy}>P_{IIy}$, and by $P_{Iy}/P_{Iy}\leqq 0.96$ and $P_{IIy}/P_{IIy}\leqq 0.96$ in the case where the abscissa value is smaller than 1 so that there are relations $P_{Iy}<P_{Iy}$ and $P_{IIy}<P_{IIy}$.

Further, in Example 8, the near-end crosstalk attenuations described in connection with Example 7 were measured in a manner such that the twist pitches of insulated wire pairs 14 were adjusted to 9.0 mm, 10.0 mm, 11.0 mm, and 12.0 mm, respectively, for Type I, just as in Example 7, and to 16.0 mm, 19.0 mm, 23.0 mm, and 28.0 mm, respectively, for Type II so that expressions (1) and (2) or expressions (1) and (3) should be fulfilled, and that the same conditions of Example 7 were used for others. Unlike Example 7, Example 8 is arranged so that the twist pitches of the four insulated wire pairs (5) to (8) which constitute Type II are all longer than those of the four insulated wire pairs (1) to (4) which constitute Type I.

When measurement and evaluation were conducted by the same methods as in Example 7, the criterion, standard value+11 dB, shown in Table 4 was able to be met for any combinations of insulated wire pairs 14 in each unit 12, in each two adjacent units 12, and in each two every-third units 12. In each two alternate units 12 of Type II and Type I, however, the criterion, standard value+11 dB, shown in Table 4 was not able to be met for those combinations of insulated wire pairs 14 having the same twist pitches ($P_{IIy}/P_{IIy}=1$) in which the product ($P_{IIy}\times P_{IIy}$) of the unit lengthwise components $P_{IIy}$ was large.

Thereupon, dimensional limits of the twist pitches were examined such that a satisfactory crosstalk characteristic can be obtained even with combinations of insulated wire pairs 14 having the same twist pitches.

Figure 13:
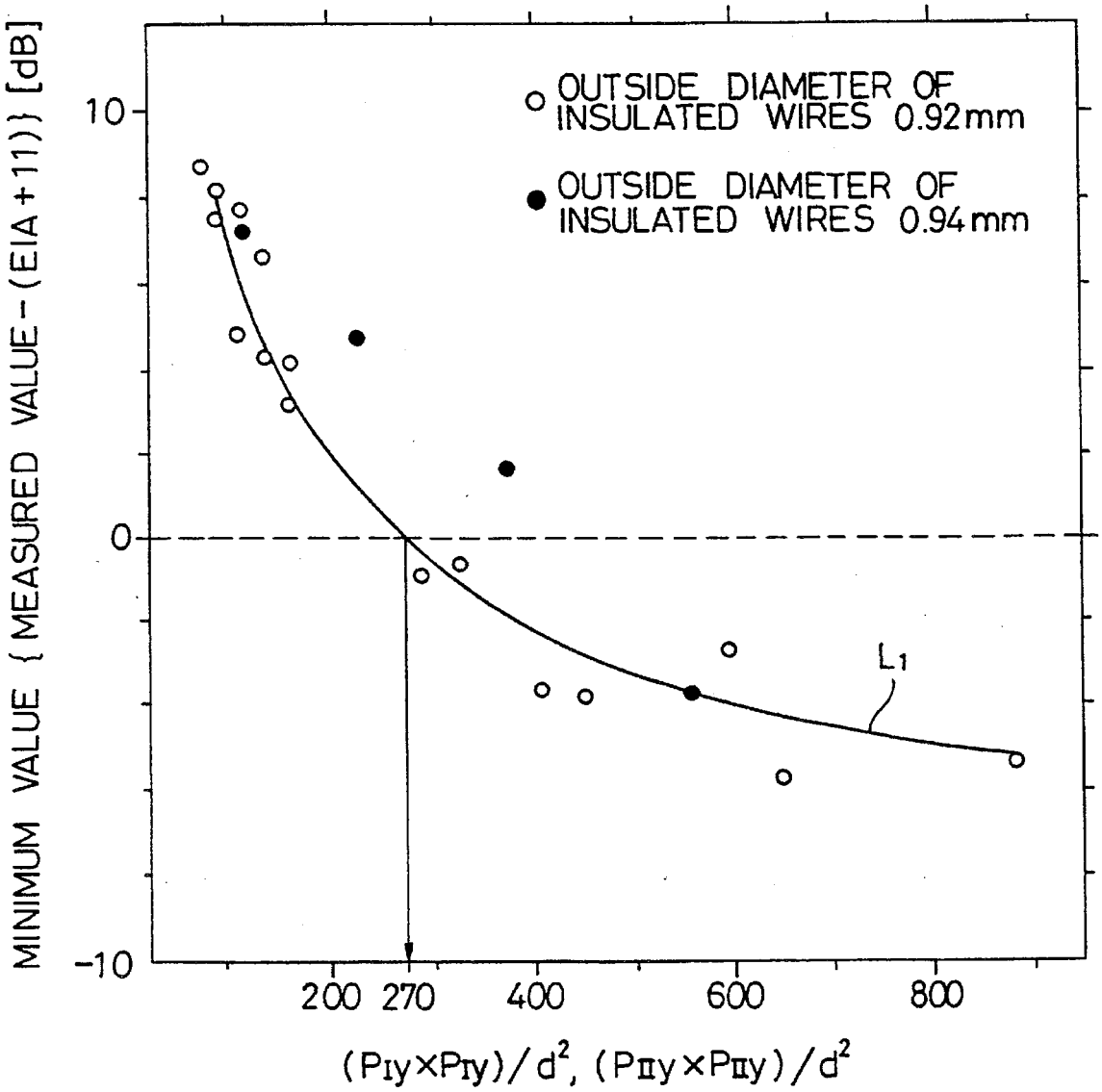
FIG. 13 is a plot diagram showing the relationship between near-end crosstalk attenuations, obtained for combinations of insulated wire pairs having the same twist pitches in each two alternate units according to Examples 1 to 4 shown in Tables 2 and 3 and Examples 7 and 8 shown in Table 5, and the ratio ($P_{Iy} \times P_{Iy}/d^2$, $P_{IIy} \times P_{IIy}/d^2$) of the product of the unit diametrical components of the twist pitches of insulated wire pairs which constitute the units of Types I and II, individually, to the square of the outside diameter d of insulated wires.

More specifically, all data for only the combinations of insulated wire pairs 14 having the same twist pitches were extracted from the combinations of insulated wire pairs 14 in each two alternate units 12, in Examples 1 to 4 shown in Tables 2 and 3 and Examples 7 and 8 shown in Table 5. FIG. 13 shows these data. In in the diagram of FIG. 13, the axis of abscissa represents the ratio between the square ($d^2$) of the outside diameter d of the insulated wires 16 and the product ($P_{Iy}\times P_{Iy}$) of the unit lengthwise components $P_{Iy}$ of the twist pitch $P_I$ of the insulated wire pair $T_I$, which constitutes the unit $U_I$ of Type I, and the ratio between the square ($d^2$) of the outside diameter d and the product ($P_{IIy}\times P_{IIy}$) of the unit lengthwise components $P_{IIy}$ of the twist pitch $P_{II}$ of the insulated wire pair $T_{II}$, which constitutes the unit $U_{II}$ of Type II, while the axis of ordinate represents the minimum value of difference in all frequency bands obtained by subtracting the sum of each standard value shown in Table 4 and 11 dB from the measured value of the near- end crosstalk attenuation obtained for each combination of insulated wire pairs 14. The near-end crosstalk attenuations for the combinations of insulated wire pairs 14 were evaluated with reference to FIG. 13.

The abscissa axis of FIG. 13, unlike those of FIGS. 8 and 11, represents the ratio between the square ($d^2$) of the outside diameter d and the product of the unit lengthwise components of the twist pitches, not the product of the unit lengthwise components itself. This ratio was represented in order to evaluate the near-end crosstalk attenuations under the same.conditions, since the value of the outside diameter d of the insulated wire pairs 14 varies between 0.92 mm for Examples 1 to 4 shown in Tables 2 and 3 and 0.94 mm or Examples 7 and 8 shown in Table 5 (see Tables 2 and 5). Since the abscissa axis of FIG. 13 represents the ratio between the square ($d^2$) of the outside diameter d of the insulated wires 16 and the product ($P_{Iy}\times P_{Iy}$ or $P_{IIy}\times P_{IIy}$) of the unit lengthwise components of the same twist pitch, moreover, the (½)'th power of the abscissa value is equal to the ratio ($P_{Iy}/d$ or $P_{IIy}/d$) between the unit lengthwise component of the twist pitch of each insulated wire pair 14 and the outside diameter of the insulated wires 16.

The abscissa value was found to be 270 (square root of which is about 16.42) when the dimensional limits of the twist pitches were obtained from the point of intersection between a characteristic curve $L_1$ of FIG. 13 related to the same twist pitch specified by each plot and a broken line for the criterion, standard value+11 dB, shown in Table 4, which corresponds to the ordinate value of 0 dB. As shown in FIG. 13, therefore, the criterion, standard value+11 dB, shown in Table 4 cannot be met by the combinations of the insulated wire pairs 14 having the same twist pitches in the case where the ratio between the unit lengthwise component of each twist pitch and the outside diameter d of the insulated wires 16 exceeds 16.4.

Thus, in the case where $P_{Iy}/d>16.4$ or $P_{IIy}/d>16.4$ is given for both of each two alternate units 12, that is, if "$P_{iy}/d>16.4$, $P_{ky}/d>16.4$" is given where the twist pitches of the insulated wire pairs $T_i$ and $T_k$ optionally selected among a plurality of insulated wire pairs 14 which constitute optionally selected two alternate units $U_i$ and $U_k$ are $P_i$ and $P_k$, respectively, the insulated wire pairs 14 having the same twist pitgh should never be combined, and it is necessary to combine the insulated wire pairs having different twist pitches.

According to the present invention, the prior conditions of expression (4) were obtained in the aforementioned manner.

If the twist pitch values of the insulated wire pairs 14 must be differentiated to meet the prior conditions of expression (4), a satisfactory crosstalk characteristic can be obtained for each two alternate units 12 by selecting the twist pitches of the insulated wire pairs 14 from a region such that the ratio between the unit lengthwise components of the twist pitches of the insulated wire pairs 14 is given by $P_{Iy}/P_{Iy}\geqq 1.04$ and $P_{IIy}/P_{IIy}\geqq 1.04$ in the case where there are relations $P_{Iy}>P_{Iy}$ and $P_{IIy}>P_{IIy}$ ("if $P_i>P_k$, then $P_{Iy}/P_{Iy}\geqq 1.04$"), and by $P_{Iy}/P_{Iy}\leqq 0.96$ and $P_{IIy}/P_{IIy}\leqq 0.96$ in the case where there are relations $P_{Iy}<P_{Iy}$ and $P_{IIy}<P_{IIy}$ ("if $P_i<P_k$, then $P_{Iy}/P_{Iy}\leqq 0.96$"), as seen from FIG. 12 mentioned before. Expression (4) was obtained in this manner.

$P_{iy}/d>16.4$ and $P_{ky}/d>16.4$ were positively used as the prior conditions for the following reason. As seen from the aforesaid results of Example 7 shown in FIGS. 11 and 12, these prior conditions cannot be fulfilled in the case of combinations with the same twist pitches (e.g., combinations of the insulated wire pairs (1) and (1), (2) and (2), etc. of type I shown in Table 5), as well as in the case where different twist pitches are combined so that either $P_{iy}/d$ or $P_{ky}/d$ is smaller than 16.4 (e.g., combinations of the insulated wire pair (5) and the insulated wire pairs (6) to (8) of Type II shown in Table 5) or that both $P_{iy}/d$ and $P_{ky}/d$ are smaller than 16.4 (e.g., combination of the insulated wire pairs (1) and (2), etc. of Type I shown in Table 5). Even in these cases, a satisfactory crosstalk characteristic can be obtained for each two alternate units 12 if expressions (1) and (2) or expressions (1) and (3) are fulfilled. Thus, these cases can be covered by the scope of the present invention as long as expressions (1) to (3) are fulfilled.

Expressions (1) to (4) were obtained in this manner. In Example 7 shown in Table 5, which was arranged so as to fulfill expressions (1) to (3), there were combinations of insulated wire pairs 14 with which the criterion, standard value+11 dB, shown in Table 4 was not able to be met for each two alternate units 12. As is evident from this fact, expression (4), besides expressions (1) and (2) or expressions (1) and (3), must be fulfilled for the combinations of insulated wire pairs 14 which meet the prior conditions of expression (4). Thus, each communication cable 10 incorporates combinations of insulated wire pairs 14 which are expected only to fulfill expressions (1) to (3) and combinations of wire pairs 14 which must fulfill expression (4) besides expressions (1) to (3).

Moreover, it was indicated by the aforementioned processes of obtaining expressions (1) to (4) that the relations betw&en the twist pitches of the insulated wire pairs 14 and the arrangement of the units should only be specified so as to fulfill the following conditions (a) to (d), in order to apply those expressions to communication cables 10.

First, as a condition (a), the twist pitch $P_i$ of the insulated wire pair $T_i$ optionally selected among a plurality of insulated wire pairs 14 which constitute the unit $U_i$ is selected from a region given by $P_{iy}/d \leqq 16.4$. Thus, in the unit $U_i$, the twist pitches of all the insulated wire pairs 14 are defined by $P_{iy}/d \leqq 16.4$. By doing this, a satisfactory crosstalk characteristic can be obtained more effectively for the relations between the twist pitches of a plurality of insulated wire pairs 14 which constitute the adjacent or alternate unit $U_j$ or $U_k$.

Then, as a condition (b), a twist pitch $P_{ja}$ of one insulated wire pair $T_{ja}$ among the wire pairs 14 which constitute the unit $U_j$ adjacent to the unit $U_i$ which fulfills the condition (a), with respect to the twist pitch $P_j$ of the insulated wire pairs 14 which constitute the unit $U_j$, is set so as to be smaller than a minimum value $P_{i(min)}$ of the twist pitch $P_i$ ($P_{i(min)}>P_{ja}$), and the relation between the twist pitch $P_{ja}$ and the minimum value $P_{i(min)}$ of the twist pitch $P_i$ fulfills $P_{i(min)y}/P_{jay} \geqq 1.09$ of expression (3). On the other hand, twist pitches $P_{jR}$ of the insulated wire pairs 14 other than the one insulated wire pair $T_{ja}$, among the insulated wire pairs 14 which constitute the unit $U_j$, is given by $P_i<P_{jR}$, and the relation between the twist pitches $P_{jR}$ and $P_i$ is set so as to fulfill $P_{iy}/P_{jRy} \leqq 0.8$ of expression (2).

As described in connection with the set values of Example 7 shown in Table 5, the condition (b) was obtained in consideration of the fact that the nearend crosstalk attenuation between the two adjacent units $U_i$ and $U_j$ is improved if one of the insulated wire pairs 14 has a twist pitch smaller than the minimum value $P_{i(min)}$ of the twist pitches of the insulated wire pairs 14 of the unit $U_i$ which fulfills the condition (a). In the case where the unit $U_j$ is composed of four insulated wire pairs 14, for example, the aforesaid attenuation increases if the twist pitches of too many wire pairs 14, e.g., all or three of them, are set to be short enough to fulfill expression (3) with respect to the insulated wire pairs 14 which constitute the unit $U_i$. Accordingly, all the twist pitches $P_{jR}$ of the insulated wire pairs 14 other than a minimum value $P_{j(min)}$ of the twist pitches were set to be longer than the twist pitches of any insulated wire pairs 14 which constitute the unit $U_i$.

Thus, only the twist pitch $P_{ja}$, out of the twist pitches $P_j$ of the insulated wire pairs 14 which constitute the unit $U_j$, was set so as to fulfill expression (3) with respect to the minimum value $P_{i(min)}$ of the twist pitches $P_i$ of the insulated wire pairs 14 which constitute the unit $U_i$, and the other twist pitches $P_{jR}$ were set so as to fulfill expression (2) with respect to the twist pitches of all the insulated wire pairs 14 which constitute the $U_i$.

In this case, $P_{i(min)y}/P_{jay} \geqq 1.09$ of expression (3) is used because the twist pitch $P_{ja}$ is in compliance with $P_{i(min)y}>P_{jay}$ ($P_{j(min)y}$), while $P_{iy}/P_{jRy} \leqq 0.8$ of expression (2) is used because the other twist pitches $P_{jR}$ are based on $P_{iy}<P_{jRy}$. Since all the twist pitches $P_{jR}$ other than the minimum value $P_{j(min)}$ are set to be longer than the twist pitch $P_j$ selected from the range $P_{iy}/d \leqq 16.4$, $P_{jRy}/d>16.4$ is obtained. It is to be understood that the twist pitches $P_i$ and $P_j$ of the insulated wire pairs 14 of the units $U_i$ and $U_j$ should fulfill expression (1), since the units $U_i$ and $U_j$ are two adjacent units 12.

As a condition (c), moreover, each of units $U_{i1}$ to $U_{in}$ arranged alternately following the unit $U_i$ which fulfills the condition (a) is composed of a plurality of insulated wire pairs 14 having the same twist pitches as the wire pairs 14 which constitute the unit $U_i$. Thus, the units $U_{i1}$ to $U_{in}$ have quite the same twist pitch configuration. For example, if the twist pitches of the insulated wire pairs 14 which constitute the unit $U_i$ are 9.0 mm, 10.0 mm, 11.0 mm, and 12.0 mm, individually (in the case of the four insulated wire pairs 14A to 14D shown in FIG. 1), the twist pitches of the insulated wire pairs 14 which constitute each of the units $U_{i1}$ to $U_{in}$ are also 9.0 mm, 10.0 mm, 11.0 mm, and 12.0 mm, individually. In this arrangement, as mentioned in connection with the processes of obtaining expression (4), a satisfactory crosstalk characteristic can be obtained for each two alternate units 12 if $P_{iy}/d \leqq 16.4$ is given.

Finally, as a condition (d), a minimum value $P_{j1(min)}$ of twist pitches $P_{j1}$ of a plurality of insulated wire pairs 14 which constitute a certain unit $U_{j1}$ next to the unit $U_j$ but one is set so as to be equal to the twist pitch $P_{ja}$ of the minimum value $P_{j(min)}$ of the twist pitch $P_j$ ($P_{j(min)}=P_{j1(min)}$), and $P_{jRy}/P_{j1Ry} \geqq 1.04$ is fulfilled when the relation between twist pitches $P_{j1R}$ other than the minimum value $P_{j1(min)}$ of the twist pitches $P_{j1}$ of the insulated wire pairs 14 which constitute the unit $U_{j1}$ and twist pitches $P_{jR}$ other than the twist pitch $P_{ja}$ of the minimum value $P_{j(min)}$ of the twist pitch $P_j$ of the insulated wire pairs 14 which constitute the unit $U_j$ which fulfills the condition (b) is given by $P_{jRy}>P_{j1Ry}$, and $P_{jRy}/P_{j1Ry} \leqq 0.96$ is fulfilled when the relation is given by $P_{jRy}<P_{j1Ry}$.

In this case, the relation between the twist pitches of a plurality of insulated wire pairs 14 which constitute one unit 12 and the twist pitches of a plurality of insulated. wire pairs 14 which constitute the other unit 12, out of two alternate units 12 (e.g., units $U_{j1}$ and $U_{j2}$, units $U_{j2}$ and units $U_{j3}$, etc.) optionally selected among units $U_{j1}$ to $U_{jn}$ arranged alternately following the unit $U_j$ which fulfills the condition (b), is set so as to fulfill the condition (d).

As mentioned in connection with the processes of obtaining expression (4), a satisfactory crosstalk characteristic can be obtained for each two alternate units 12 if $P_{jy}/d \leqq 16.4$ and $P_{j1y}/d \leqq 16.4$ are given, even in case of combinations of the same twist pitch. Accordingly, the condition (d) is provided so that the minimum value $P_{j1(min)}$ of the twist pitches $P_{j1}$ is equal to the twist pitch $P_{ja}$ of the minimum value $P_{j(min)}$ of the twist pitch $P_j$ ($P_{j(min)}=P_{j1(min)}$).

As described in connection with the condition (b), on the other hand, the other twist pitches $P_{jR}$ and $P_{j1R}$, based on $P_{jRy}/d>16.4$ and $P_{j1Ry}/d>16.4$ so as to fulfill expression (3), with respect the twist pitch $P_i$ (including a twist pitch $P_{i1}$) of the unit $U_j$ adjacent to the unit $U_i$ (including the unit $U_{i1}$ having the same twist pitch configuration as the unit $U_i$ under the condition (c)) which fulfills the condition (a), are in compliance with $P_{iRy}/d>16.4$ and $P_{i1Ry}/d>16.4$ (mentioned before in the processes of obtaining expression (4)). Thus, the twist pitches $P_{jR}$ and $P_{j1R}$ should not be made equal, that is, they should be differentiated, so that expression (4) is applicable.

In this case, moreover, the twist pitches of the insulated wire pairs 14 become equal, so that the near- end crosstalk attenuation cannot meet the criterion, standard value+11 dB, shown in Table 4, unless all the combinations of alternate units 12, ranging from the unit $U_j$ to unit $U_{jn}$, such as combinations of the units $U_{j1}$ and $U_{j2}$ and units $U_{j2}$ and $U_{j3}$, as well as the combination of the units $U_j$ and $U_{j1}$, are covered. Thus, the units $U_{j1}$ to $U_{jn}$ arranged alternately following the unit $U_j$ which fulfills the condition (b), unlike the unit $U_i$ which fulfills the condition (a), cannot enjoy the same twist pitch configuration, and must be of different types. The condition (d) was obtained in consideration of these circumstances.

In the case of a specific communication cable 10 which includes six units 12, as shown in FIG. 6A, those units 12 which fulfill the condition (a) are arranged alternately as units of Type I under the conditions (a) to (d). Also, those units 12 which fulfill the condition (b) are arranged as Type II, and those units 12 which are situated next to the units of Type II but one are arranged as Type III. Likewise, those units 12 which are situated next to the units of Type III are arranged as Type IV. Naturally, the condition (d) must be applicable to a combination of Types II and IV, two alternate units 12.

Referring to FIG. 1, the units 12 may be classified into four types, including the units 12A, 12C and 12E of Type I, the unit 12B of Type II adjacent to the unit 12A, the unit 12D of Type III, and the unit 12F of Type IV. In this case, the units 12A, 12C and 12E of Type I are designed so that the twist pitches $P_A$ to $P_D$ of the insulated wire pairs 14A to 14D are in compliance with $P_{Ay}/d \leqq 16.4$, $P_{By}/d \leqq 16.4$, $P_{Cy}/d \leqq 16.4$, and $P_{Dy}/d \leqq 16.4$, according to the condition (a), and $P_A=P_A$, $P_B=P_B$, $P_C=P_C$, and $P_D=P_D$, according to the condition (c).

If the minimum values of the twist pitches of the adjacent units 12A and 12B of Types I and II are $P_{A(min)}$ and $P_{B(min)}$, respectively, the units 12A and 12B are based on relations $P_{A(min)}>P_{B(min)}$ and $P_{A(min)}/P_{B(min)} \geqq 1.09$ according to the condition (b). All of the twist pitches $P_C$, $P_D$ and $P_A$ other than the twist pitch $P_B$ of the unit 12B of Type II are longer than the twist pitch of the unit 12A, and their relations with the twist pitches $P_A$ to $P_D$ of the unit 12A of Type I are given by $P_{Cy}/(P_{Aj}, , P_{Dy}) \leqq 0.8$, $P_{Dy}/(P_{Aj}, , P_{Dy}) \leqq 0.8$, $P_{Ay}/(P_{Aj}, , P_{Dy}) \leqq 0.8$, respectively.

It is to be understood that the above relations are established for any of six pairs of adjacent units 12, including the unit pairs 12A and 12F, 12C and 12B, 12C and 12D, 12E and 12D, and 12E and 12F, besides the pair 12A and 12B.

The minimum values of the respective twist pitches of the unit 12B of Type II, unit 12D of Type III, and unit 12F of Type IV are all equal ($P_{(min)}$). Moreover, the twist pitches of any pairs of alternate units 12 including the units 12B, 12D and 12F (e.g., twist pitch $P_A$ of the insulated wire pair 14A of the unit 12B and the twist pitch $P_D$ of the unit 12D, etc.) other than the minimum twist pitch $P_{(min)}$ are different from one another, fulfilling expression (4).

Likewise, if the twist pitches of the units 12B and 12D are $P_B$ and $P_D$, respectively, $P_B/P_D \geqq 1.04$ and $P_B/P_D \leqq 0.96$ are obtained in the case where $P_B>P_D$ and $P_B<P_D$ are given, respectively.

The near-end crosstalk attenuations obtained with respect to the twist pitches of the insulated wire pairs 14 in each two adjacent or alternate units 12 are supposed to be able to meet the criterion, standard value+11 dB, shown in Table 4 if the twist pitches of the wire pairs 14 are selected in the aforesaid manner.

According to the condition (b), among the conditions (a) to (d), only one insulated wire pair 14 having a twist pitch smaller than the minimum value $P_{i(min)}$ of the twist pitches of the insulated wire pairs 14 which constitute the unit $U_i$ is provided in each two adjacent units 12. It is believed, however, that a satisfactory crosstalk characteristic can be also obtained with use of two such short-pitch insulated wire pairs 14. Accordingly, it is supposed to be necessary only that the relations between the twist pitches of the insulated wire pairs 14 and the arrangement of the units 12 be specified so as to fulfill the following conditions (e) and (f).

First, as a condition (e), the twist pitch $P_i$ of the insulated wire pair $T_i$ optionally selected among a plurality of insulated wire pairs 14 which constitute the unit $U_i$ is selected from the region given by $P_{iy}/d \leqq 16.4$. This condition (e) is identical with the condition (a).

Then, as a condition (f), twist pitches $P_{ja}$ and $P_{jb}$ of two insulated wire pairs $T_{ja}$ and $T_{jb}$ among a plurality of insulated wire pairs 14 which constitute the unit $U_j$ adjacent to the unit $U_i$ which fulfills the condition (e), with respect to the twist pitch $P_j$ of the insulated wire pairs 14 which constitute the unit $U_j$, are set so as to be smaller than the minimum value $P_{i(min)}$ of the twist pitch $P_i$ ($P_{i(min)}>P_{ja}$, $P_{i(min)}>P_{jb}$), and the relation between the twist pitch $P_{ja}$ and the minimum value $P_{i(min)}$ of the twist pitch $P_i$ and the relation between the twist pitch $P_{jb}$ and the minimum value $P_{i(min)}$ fulfill $P_{i(min)y}/P_{jay} \geqq 1.09$ and $P_{i(min)y}/P_{jby} \geqq 1.09$ of the expression (3), respectively. On the other hand, the twist pitches $P_{jR}$ of the insulated wire pairs 14 other than the two insulated wire pairs $T_{ja}$ and $T_{jb}$, among the insulated wire pairs 14 which constitute the unit $U_j$, are given by $P_i<P_{jR}$, and the relation between the twist pitches $P_{jR}$ and the twist pitch $P_i$ is set so as to fulfill $P_{iy}/P_{jRy} \leqq 0.8$ of the expression (2).

As a condition (g), moreover, each of the units $U_{i1}$ to $U_{in}$ arranged alternately following the unit $U_i$ which fulfills the condition (e) is composed of a plurality of insulated wire pairs 14 having the same twist pitches as the insulated wire pairs 14 which constitute the unit $U_i$. This condition (g) is also identical with the condition (c).

Finally, as a condition (h), twist pitches $P_{j1a}$ and $P_{j1b}$ of two insulated wire pairs $T_{j1a}$ and $T_{j1b}$, out of a plurality of insulated wire pairs 14 which constitute the unit $U_{j1}$ next to the unit $U_j$ but one are set so as to be equal to the twist pitches $P_{ja}$ and $P_{jb}$ ($P_{ja}=P_{j1a}$, $P_{jb}=P_{j1b}$), respectively, of the two insulated wire pairs $T_{ja}$ and $T_{jb}$ which are smaller than the minimum value $P_{i(min)}$ of the twist pitch $P_i$ of the insulated wire pairs 14 which constitute the unit $U_i$ which fulfills the condition (e), and $P_{jRy}/P_{j1Ry} \geqq 1.04$ is fulfilled when the relation between twist pitches $P_{j1R}$ other than the twist pitches $P_{j1a}$ and $P_{j1b}$, out of the twist pitches $P_{j1}$ of the insulated wire pairs 14 which constitute the unit $U_{j1}$, and twist pitches $P_{jR}$ other than the twist pitches $P_{ja}$ and $P_{jb}$, out of the twist pitches $P_j$ of the insulated wire pairs 14 which constitute the unit $U_j$ which fulfills the condition (f), is given by $P_{jRy}>P_{j1Ry}$, and $P_{jRy}/P_{j1Ry} \leqq 0.96$ is fulfilled when the relation is given by $P_{jRy}<P_{j1Ry}$.

In this case, the relation between the twist pitches of a plurality of insulated wire pairs 14 which constitute one unit 12 and the twist pitches of a plurality of insulated wire pairs 14 which constitute the other unit 12, out of two alternate units 12 optionally selected among the units $U_{j1}$ to $U_{jn}$ arranged alternately following the unit $U_j$ which fulfills the condition (f), is set so as to fulfill the condition (h). This condition (h) corresponds to the condition (d).

As seen from the condition (f), in particular, a communication cable 10 specified by these conditions (e) and (f) is constructed in the same manner as the communication cable 10 specified by the conditions (a) to (d) except that two short-pitch insulated wire pairs 14 are provided place of one. Also, the arrangements of units 12 and conditions (e) to (h)

are applied to the combinations of units 12 in substantially the same manner as the conditions (a) to (d).

The near-end crosstalk attenuations obtained with respect to the twist pitches of the insulated wire pairs 14 in each two adjacent or alternate units 12 are supposed to be able to meet the criterion, standard value+11 dB, shown in Table 4 if the twist pitches of the wire pairs 14 are selected so as to fulfill the conditions (e) to (h).

The following is a description of embodiments of the present invention in which combinations of the twist pitches of a plurality of insulated wire pairs 14 which constitute two adjacent units 12 fulfill expressions (1) and (2) or expressions (1) and (3), and in which the twist pitches of the insulated wire pairs 14 are selected so as to fulfill expression (4) additionally in the case combinations of these twist pitches are in compliance with the prior conditions of expression (4).

More specifically, expressions (1) and (4) are fulfilled in a manner such that the conditions (a) to (d) or (e) to (h) are met.

Embodiment 1

According to Embodiment 1, each of 24 pairs of communication cables 10 was manufactured by cabling six units 12 (outside diameter: 3.94 mm) around the filler 34, as shown in FIG. 1. Each unit 12 included four insulated wire pairs 14 each composed of insulated wires 16 which were each formed by covering a conductor (annealed copper wire) 18 having an outside diameter of 0.511 mm with an insulating layer (low-density polyethylene) 20 having an outside diameter of 0.96 mm, as shown in Table 6.

First, in Embodiment 1, the twist pitches of the four insulated wire pairs 14A, 14B, 14C and 14D, that is, the twist pitches with which the twin-core insulated wires 16 of the wire pairs 14 were twisted together, were adjusted to 9.0 mm, 10.0 mm, 11.0 mm, and 12.0 mm, respectively, for Type I, to 8.2 mm, 15.9 mm, 18.9 mm, and 22.9 mm, respectively, for Type II, to 8.2 mm, 17.1 mm, 20.0 mm, and 24.8 mm, respectively, for Type III, and to 8.2 mm, 18.1 mm, 21.9 mm, and 27.8 mm, respectively, for Type IV so that expressions (1) and (2) or expressions (1) and (3) should be fulfilled, or expression (4), as well as these expressions, should be additionally fulfilled in the case where its prior conditions were met. Thus, the twist pitches of the four wire pairs 14 in each unit 12, the twist pitches of the wire pairs 14 in each two adjacent units 12, and the twist pitches in each two alternate units 12, which were based on $P_{iy}/d>16.4$, $P_{IIIy}/d>16.4$, and $P_{IVy}/d>16.4$, were all different. Then, the units 12 of Type I were arranged alternately with the units 12 of Types II to IV (see Table 6), as shown in FIG. 6A. As seen from the twist pitches of Types II to IV shown in Table 6 and the arrangement of the units 12, Embodiment 1 was arranged so as to meet the conditions (a) to (d).

TABLE 6

| | | | | | | | | | |
|---|---|---|---|---|---|---|---|---|---|
| | | | | | Embodiment 1 | | | | |
| Conductor | Material | | | | Annealed copper wire | | | | |
| | Outside diameter (mm) | | | | 0.511 | | | | |
| Insulating layer | Material | | | | Low-density polyethylene | | | | |
| | Outside diameter (mm) | | | | 0.96 | | | | |
| Pair twisting (twisting of twin-core insulated wires) | Pitch (mm) | Type I | (1) | 9.0 | left-hand | Type III | (5)a | 8.2 | left-hand |
| | | | (2) | 10.0 | " | | (6)a | 17.1 | " |
| | | | (3) | 11.0 | " | | (7)a | 20.0 | " |
| | | | (4) | 12.0 | " | | (8)a | 24.8 | " |
| | | Type II | (5) | 8.2 | left-hand | Type IV | (5)b | 8.2 | left-hand |
| | | | (6) | 15.9 | " | | (6)b | 18.1 | " |
| | | | (7) | 18.9 | " | | (7)b | 21.9 | " |
| | | | (8) | 22.9 | " | | (8)b | 27.8 | " |
| Unit twisting (twisting of four pairs) | Pitch (mm) | Type I | | | 140 | | | | right-hand |
| | | Types II, III and IV | | | 160 | | | | " |
| Cabling (twisting of six units) | Method | | | | Alternate arrangement of units of Type I with units of Types II, III and IV (I→II→I→III→I→IV) | | | | |
| | Pitch | | | | 210 mm | | | | |
| Binding tape | Method | | | | Plastic tape wrapping | | | | |
| Jacket | Material | | | | PVC resin | | | | |

In this case, as shown in Table 6, the four insulated wire pairs 14A to 14D (insulated wire pairs (1) to (4) of Type I, (5) to (8) of Type II, (5)*a* to (8)*a* of Type III, and (5)*b* to (8)*b* of Type IV) in each unit 12 were twisted with two twist pitches (twist pitches of the units 12), 140 mm for Type I and 160 mm for Types II to IV, to form each unit 12. Thereupon, the units were constructed by twisting together the four insulated wire pairs 14A to 14D with twist pitches different from those of the adjacent units 12.

In Embodiment 1, all the insulated wire pairs 14 were twisted left-handed, while all the units 12 were twisted right-handed, as shown in Table 6.

First, near-end crosstalk attenuations were measured for all combinations of insulated wire pairs 14 in each unit 12 (Type II), in each two adjacent units 12 (Type I and Type II), and in each two alternate units 12 (Type II and Type III; Type III and Type IV), in Embodiment 1 shown in Table 6. FIGS. 14 to 18 show the results of this measurement.

Figure 14:
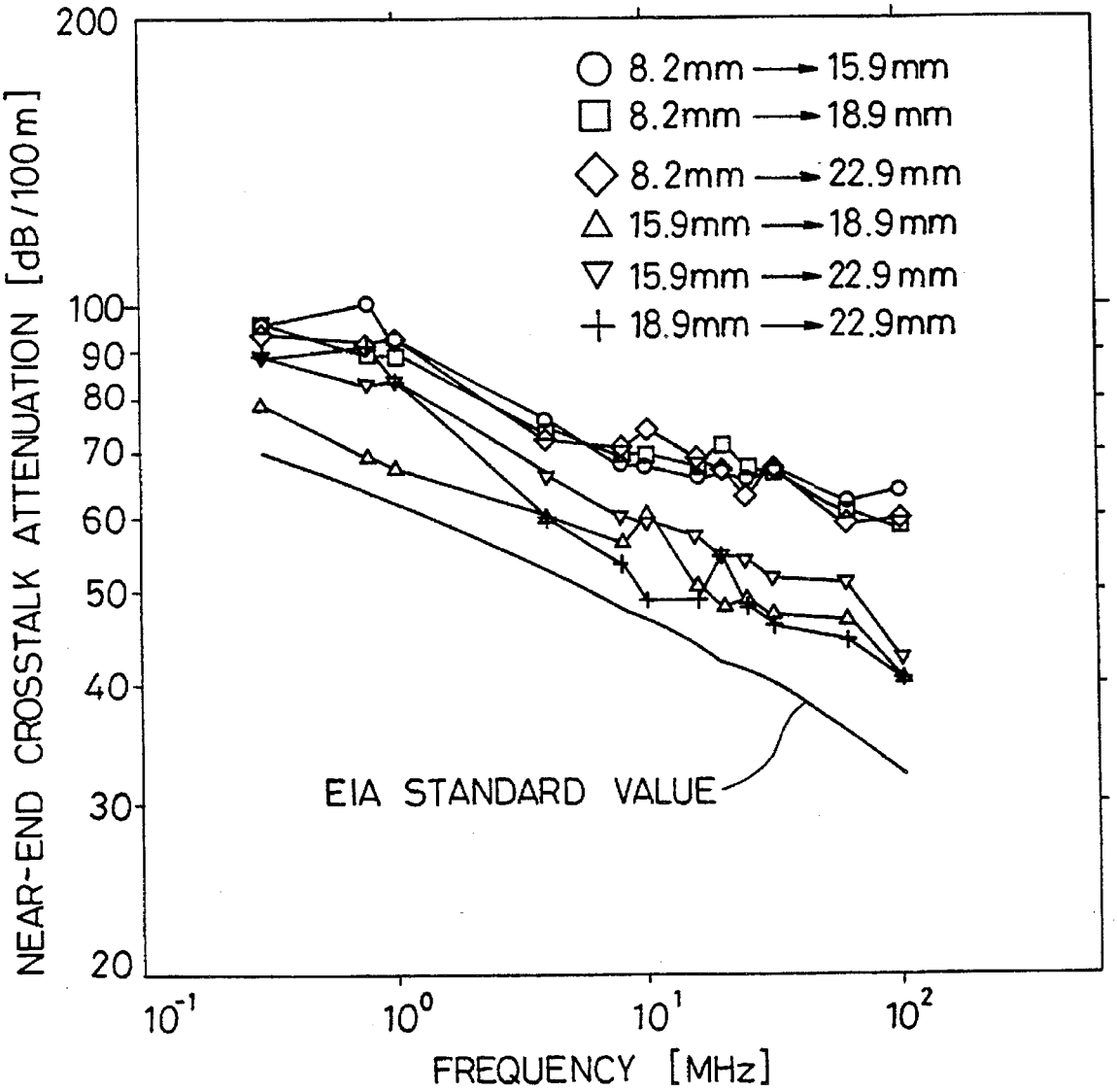
FIG. 14 is a plot diagram showing measured values of near-end crosstalk attenuations obtained for all combinations of insulated wire pairs in a unit of Type II according to Embodiment 1 of the invention shown in Table 6.

FIG. 14 shows measured values of the near-end crosstalk attenuations obtained for all the combinations of insulated wire pairs 14 in the unit 12 of Type II according to Embodiment 1. For any combination of insulated wire pairs 14 in one unit 12 (Type II), as seen from FIG. 14, the worst value of the near-end crosstalk attenuations throughout the frequency bands was able to fully meet the standard value provided by the EIA/TIA. It was indicated that combinations of insulated wire pairs 14 including a wire pair 14 which has a twist pitch of 8.2 mm (see insulated wire pair (5) shown in Table 6), among the wire pair combinations in the units 12 of Type II, in particular, enjoy a satisfactory crosstalk characteristic, providing a margin of about 10 dB or more as compared with the EIA/TIA standard value.

Figure 15:
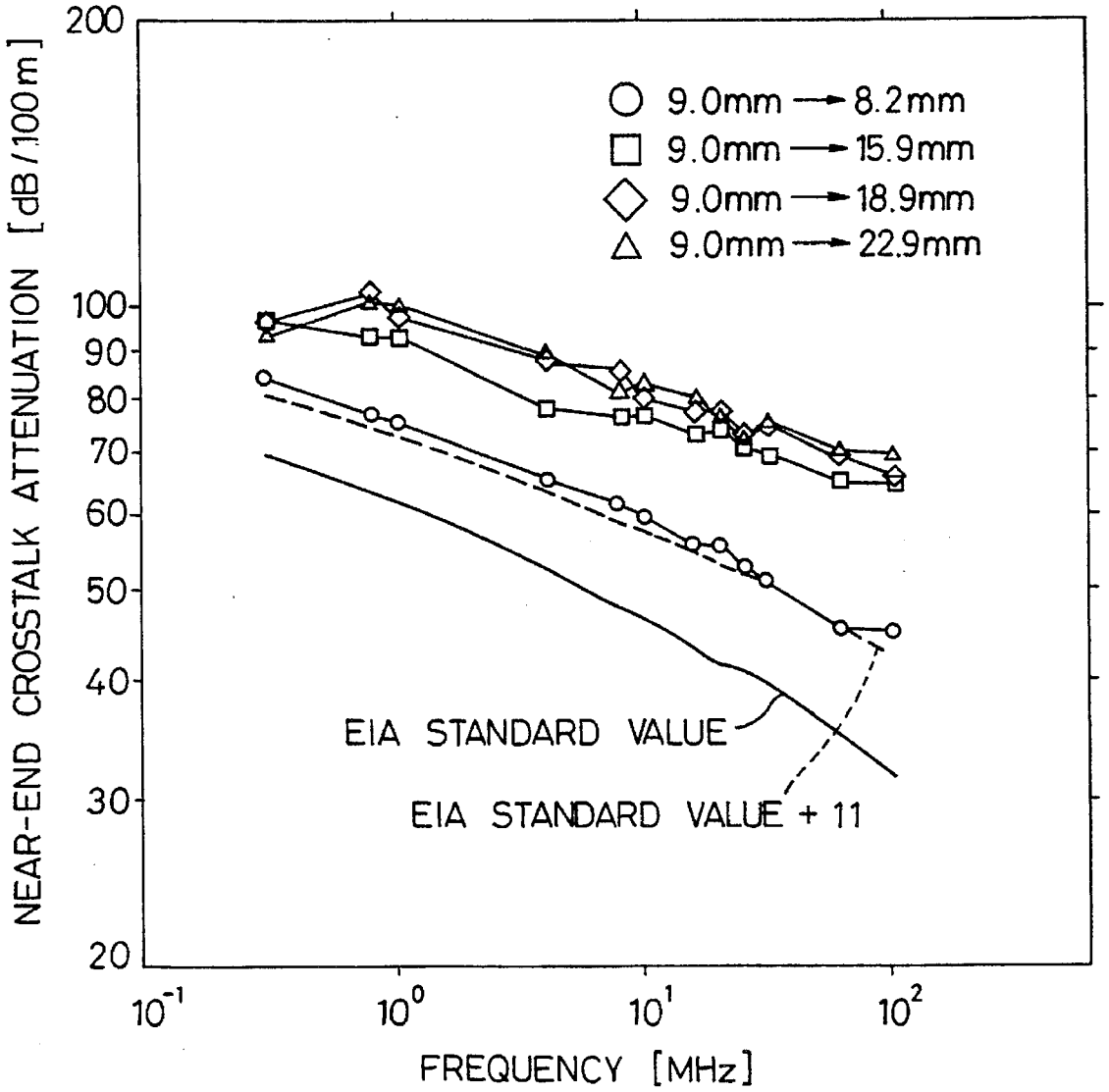
FIG. 15 is a plot diagram showing measured values of near-end crosstalk attenuations obtained for combinations of insulated wire pairs in two adjacent units (Types I and II) according to Embodiment 1 according to the invention shown in Table 6.

FIG. 15 shows measured values of the near-end crosstalk attenuations obtained for combinations of insulated wire pairs 14 in each two adjacent units (Types I and II) according to Embodiment 1. Also for any combination of insulated wire pairs 14 in each two adjacent units 12, as seen from FIG. 15, the worst value of the near-end crosstalk attenuations throughout the frequency bands was able to fully meet the criterion, EIA/TIA standard value+11 dB, and a good crosstalk characteristic was able to be obtained. Thus, according to the present invention, a satisfactory crosstalk characteristic was able to be enjoyed in the worst case.

Figure 16:
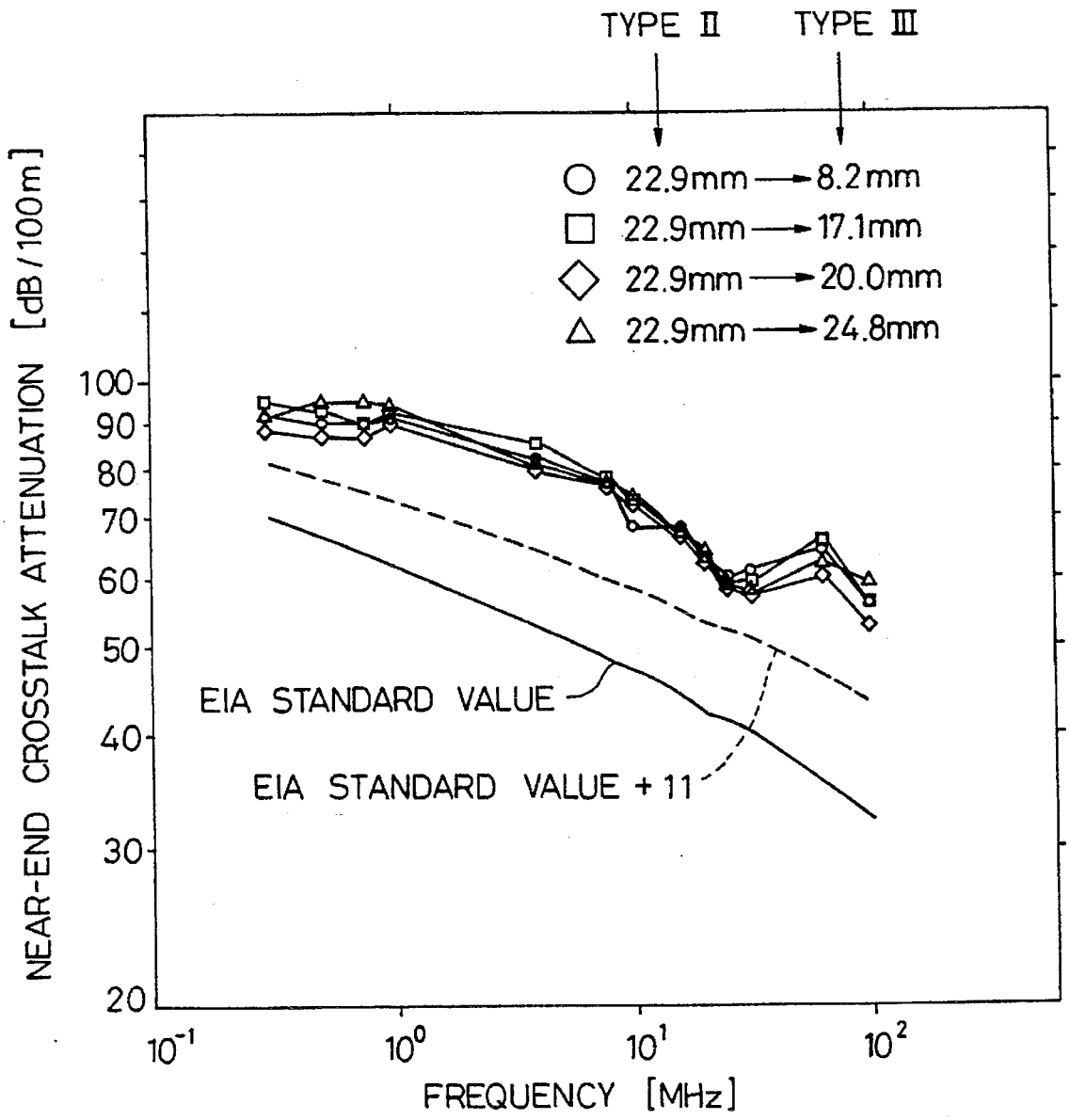
FIG. 16 is a plot diagram showing measured values of near-end crosstalk attenuations obtained for combinations of insulated wire pairs in two alternate units (Types II and III) according to Embodiment 1 according to the invention shown in Table 6.

FIG. 16 shows measured values of the near-end crosstalk attenuations obtained for combinations of insulated wire pairs 14 in each two alternate units 12 of Types II and III according to Embodiment 1. Also for any combination of insulated wire pairs 14 in each two alternate units 12, as seen from FIG. 16, the worst value of the near-end crosstalk attenuations throughout the frequency bands was able to fully meet the criterion, EIA/TIA standard value+11 dB, and a good crosstalk characteristic was able to be obtained. It was indicated, according to the present invention, that a satisfactory crosstalk characteristic can be enjoyed even in the case of combinations of insulated wire pairs 14 (insulated wire pairs (6) to (8) of Type II shown in Table 6) which have twist pitches such that the ratios between their unit lengthwise components and the outside diameter d of the insulated wires 16 are higher than 16.4, in particular, since expression (4) is fulfilled.

Figure 17:
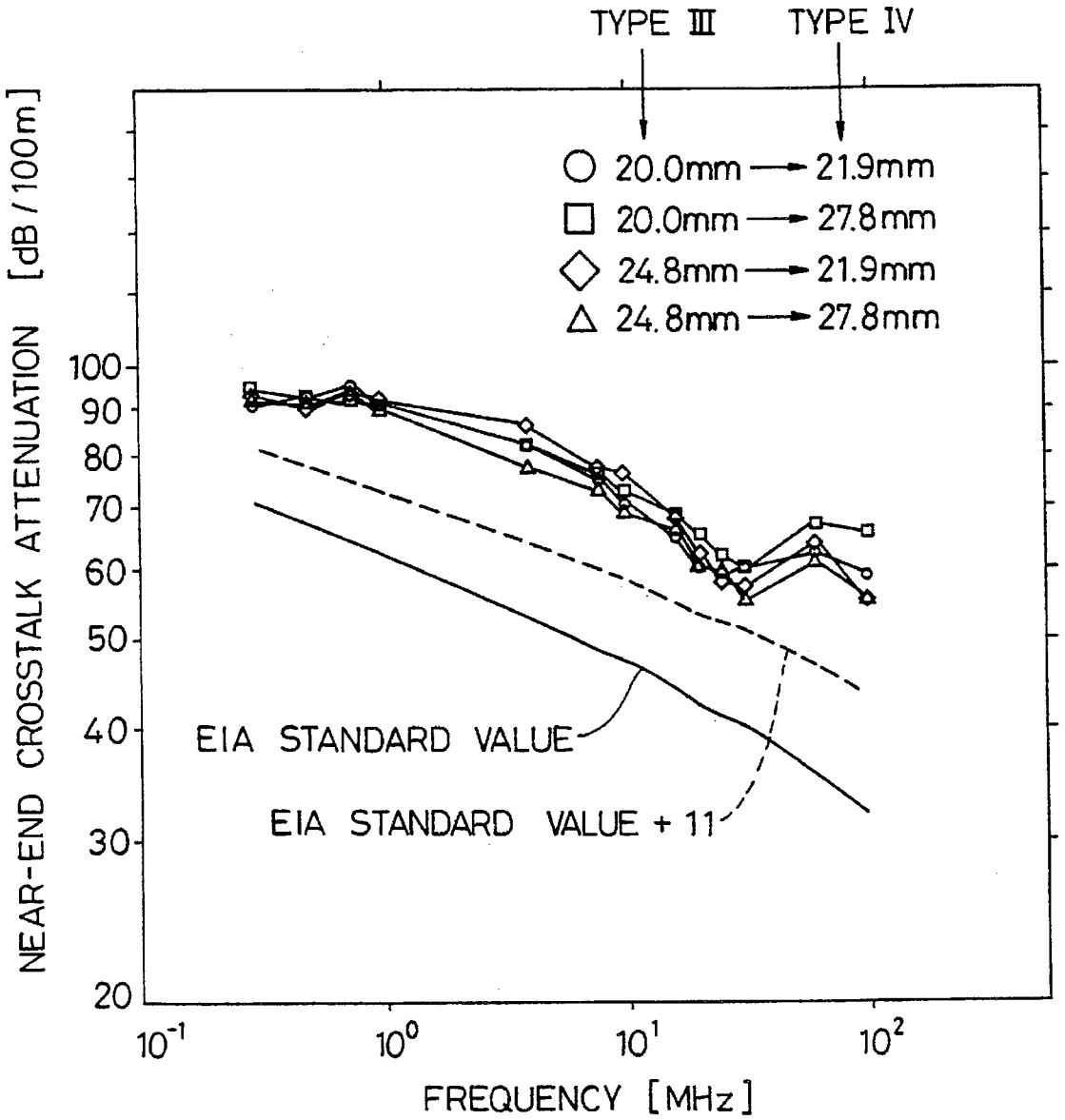
FIG. 17 is a plot diagram showing measured values of near-end crosstalk attenuations obtained for combinations of insulated wire pairs in two alternate units (Types III and IV) according to Embodiment 1 according to the invention shown in Table 6.
Figure 18:
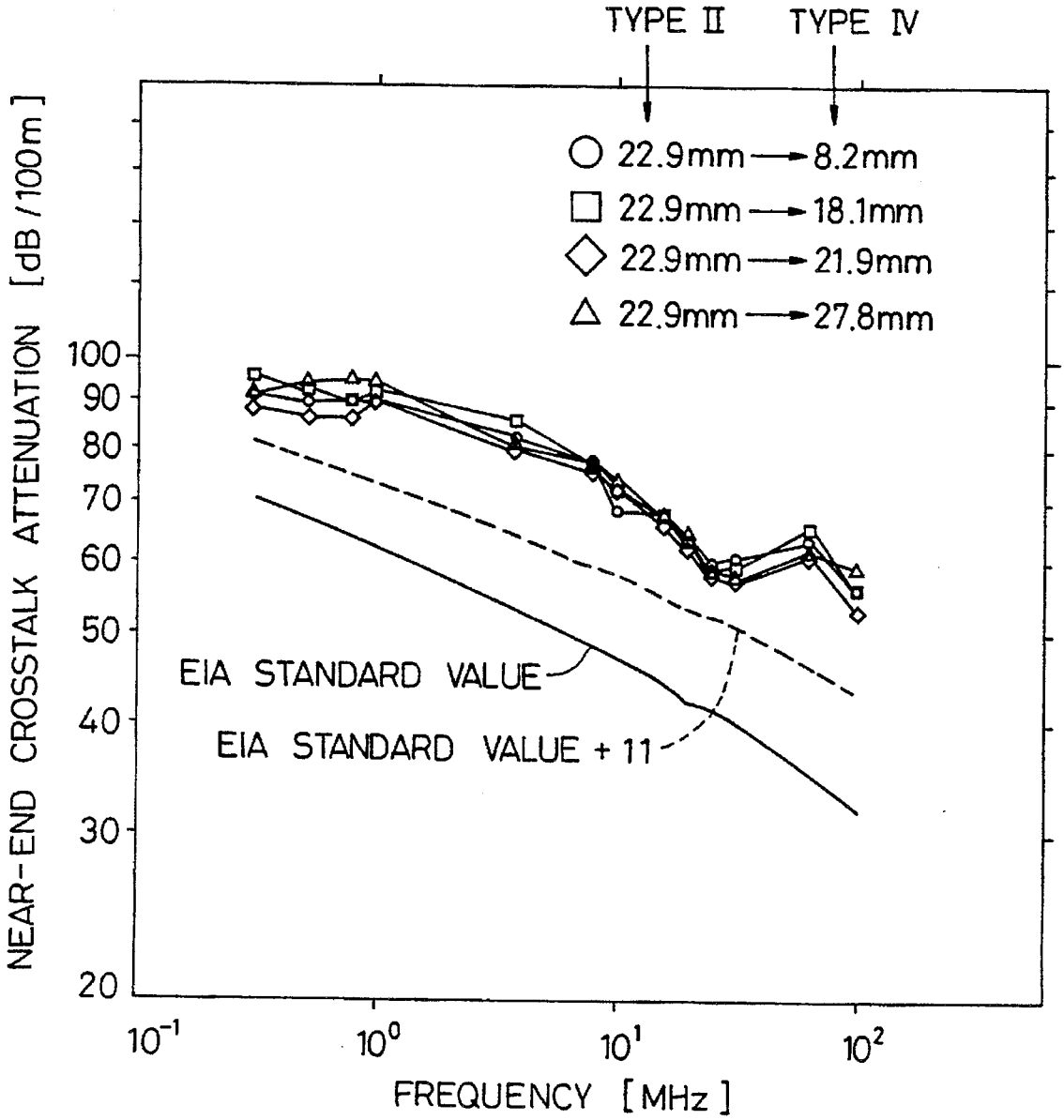
FIG. 18 is a plot diagram showing measured values of near-end crosstalk attenuations obtained for combinations of insulated wire pairs in two alternate units (Types II and IV) according to Embodiment 1 according to the invention shown in Table 6.

FIGS. 17 and 18 show measured values of the near-end crosstalk attenuations obtained for combinations of insulated wire pairs 14 in each two alternate units of Types III and IV and Types IV and II according to Embodiment 1.

As seen from FIGS. 17 and 18, the combinations of insulated wire pairs 14 in the other two alternate units were arranged so as to fulfill expression (4), a good crosstalk characteristic was able to be obtained. In other words, according to Embodiment 1, as shown in FIGS. 16 to 18, the twist pitches of the insulated wire pairs 14 are selected so as to meet the condition (d) in every two alternate units 12 which are arranged next to each corresponding unit 12 of Type II, which fulfills the condition (b), but one, as indicated by the latter half of the condition (d).

Even in the case of each two alternate units 12, $P_{ly}/d \leqq 16.4$ is given for the combinations of insulated wire pairs 14 in the units of Type I and Type I which meet the condition (a). As seen from the processes of obtaining expression (4), therefore, the criterion, standard value+11 dB, shown in Table 4 can be supposed to be met without any problem.

Embodiment 2

As Embodiment 2, communication cables 10 shown in Table 7 were manufactured by arranGinG two short-pitch insulated wire pairs 14 in each of units of Types II to IV (wire pairs (5) and (6), (5)*a* and (6)*a*, and (5)*b* and (6)*b* in Types II, II and IV, respectively) so as to include many combinations of wire pairs 14 which fulfill the condition of expression (3).

The twist pitches of the four insulated wire pairs 14A, 14B, 14C and 14D were adjusted to 9.5 mm, 10.5 mm, 11.4 mm, and 13.5 mm, respectively, for Type I, to 7.8 mm, 8.6 mm, 17.1 mm, and 20.0 mm, respectively, for Type II, to 7.8 mm, 8.6 mm, 18.0 mm, and 21.9 mm, respectively, for Type III, and to 7.8 mm, 8.6 mm, 19.0 mm, and 23.8 mm, respectively, for Type IV. Thus, according to Embodiment 2, the twist pitches of the insulated wire pairs 14 were selected so as to meet the conditions (e) to (h).

As shown in Table 7, all other conditions than the twist pitches of the insulated wire pairs 14 are identical with those of the communication cables 10 according to Embodiment 1 so that differences between the near-end crosstalk attenuations, which are attributable to differences between the twist pitches of the insulated wire pairs 14 according to Embodiments 1 and 2, are definite.

TABLE 7

| | | | | | | | | | | Embodiment 2 |
|---|---|---|---|---|---|---|---|---|---|---|
| Conductor | Material | | | | | Annealed copper wire | | | | |
| | Outside diameter (mm) | | | | | 0.511 | | | | |
| Insulating layer | Material | | | | | Low-density polyethylene | | | | |
| | Outside diameter (mm) | | | | | 0.96 | | | | |
| Pair twisting (twisting of twin-core insulated wires) | Pitch (mm) | Type I | (1) | 9.5 | left-hand | Type III | (5)a | 7.8 | left-hand |
| | | | (2) | 10.5 | " | | (6)a | 8.6 | " |
| | | | (3) | 11.4 | " | | (7)a | 18.0 | " |
| | | | (4) | 13.5 | " | | (8)a | 21.9 | " |
| | | Type II | (5) | 7.8 | left-hand | Type IV | (5)b | 7.8 | left-hand |
| | | | (6) | 8.6 | " | | (6)b | 8.6 | " |
| | | | (7) | 17.1 | " | | (7)b | 19.0 | " |
| | | | (8) | 20.0 | " | | (8)b | 23.8 | " |
| Unit twisting (twisting of four pairs) | Pitch (mm) | Type I | | | 140 | | | | right-hand |
| | | Types II, III and IV | | | 160 | | | | " |
| Cabling (twisting of six units) | Method | | | | Alternate arrangement of units of Type I with units of Types II, III and IV (I→II→I→III→I→IV) | | | | |
| | Pitch | | | | 210 mm | | | | |
| Binding tape | Method | | | | Plastic tape wrapping | | | | |
| Jacket | Material | | | | PVC resin | | | | |

In Embodiment 2, as in Embodiment 1, near-end crosstalk attenuations were measured for all combinations of insulated wire pairs 14 in each unit 12 (Type II), in each two adjacent units 12 (Type I and Type II), and in each two alternate units 12 (Type II and Type III; Type III and Type IV). In all these cases, a satisfactory crosstalk characteristic was able to be obtained, and the crosstalk characteristic for the insulated wire pairs 14 in each unit (Type II), in particular, was found to be improved. As seen from Embodiment 2, the near-end crosstalk attenuation for the insulated wire pairs 14 in each unit 12, in each communication cable 10, can be improved by incorporating insulated wire pairs 14 having relatively short twist pitches in the unit.

Table 8 shows the ranges of the respective left sides of expressions (1) to (4) as criteria for the selection of the twist pitches of the insulated wire pairs 14 according to Embodiments 1 and 2 shown in Tables 6 and 7. $P_{Ix}$, $P_{Iy}$, $P_{IIx}$ and $P_{IIy}$ were obtained to find the numerical values in Table 8 with the outside diameter d of the insulated wires 16 adjusted to 0.96 mm, the outside diameter $D_{ui}$ of the units 12 to 3.94 mm, and the twist pitches $P_{ui}$ (see FIG. 4 and expressions (4) and (5)) of the units 12 to 140 mm for Type I and to 160 mm for Types II to IV, as shown in Tables 6 and 7.

TABLE 8

(1) $P_{Iy} \times P_{IIy}/d^2$, $P_{Iy} \times P_{IIIy}/d^2$, or $P_{Iy} \times P_{IVy}/d^2 \leqq 144$:

| | $P_{Iy} \times P_{IIy}/d^2$<br>$P_{Iy} \times P_{IIIy}/d^2$<br>$P_{Iy} \times P_{IVy}/d^2$ | | $P_{Ix} \times P_{IIx}/d^2$<br>$P_{Ix} \times P_{IIIx}/d^2$<br>$P_{Ix} \times P_{IVx}/d^2$ | | $P_{Iy}/P_{IIy}$<br>$P_{Iy}/P_{IIIy}$<br>$P_{Iy}/P_{IVy}$ | |
|---|---|---|---|---|---|---|
| | Max | Min | Max | Min | Max | Min |
| Embodiment 1 | 105.1<br>(96.91) | 79.52<br>(73.29) | 0.68<br>(0.63) | 0.52<br>(0.48) | 1.45 | 1.097 |
| Embodiment 2 | 125.08<br>(115.28) | 79.82<br>(73.57) | 0.80<br>(0.74) | 0.50<br>(0.47) | 1.72 | 1.10 |

*Parenthesized FIGS. represent $P_{Iy} \times P_{IIy}$, $P_{Iy} \times P_{IIIy}$, $P_{Iy} \times P_{IVy}$ or $P_{Ix} \times P_{IIx}$, $P_{Ix} \times P_{IIIx}$, $P_{Ix} \times P_{IVx}$.

(2) $144 < P_{Iy} \times P_{IIy}/d^2$, $P_{Iy} \times P_{IIIy}/d^2$, or $P_{Iy} \times P_{IVy}/d^2 \leqq 413$:

| | $P_{Iy} \times P_{IIy}/d^2$<br>$P_{Iy} \times P_{IIIy}/d^2$<br>$P_{Iy} \times P_{IVy}/d^2$ | | $P_{Ix} \times P_{IIx}/d^2$<br>$P_{Ix} \times P_{IIIx}/d^2$<br>$P_{Ix} \times P_{IVx}/d^2$ | | $P_{Iy}/P_{IIy}$<br>$P_{Iy}/P_{IIIy}$<br>$P_{Iy}/P_{IVy}$ | |
|---|---|---|---|---|---|---|
| | Max | Min | Max | Min | Max | Min |
| Embodiment 1 | 356.50<br>(328.55) | 154.21<br>(142.12) | 2.34<br>(2.164) | 1.009<br>(0.93) | 0.74 | 0.32 |
| Embodiment 2 | 346.18<br>(319.04) | 175.94<br>(161.23) | 2.24<br>(2.07) | 1.13<br>(1.047) | 0.78 | 0.39 |

*Parenthesized FIGS. represent $P_{Iy} \times P_{IIy}$, $P_{Iy} \times P_{IIIy}$, $P_{Iy} \times P_{IVy}$ or $P_{Ix} \times P_{IIx}$, $P_{Ix} \times P_{IIIx}$, $P_{Ix} \times P_{IVx}$.

(3) $P_{IIy}/d$, $P_{IIIy}/d$, or $P_{IVy}/d > 16.4$:

| | Ratio between $P_{IIy}$ and $P_{IIIy}$ | | Ratio between $P_{IIIy}$ and $P_{IVy}$ | | Ratio between $P_{IVy}$ and $P_{IIy}$ | |
|---|---|---|---|---|---|---|
| | Max | Min | Max | Min | Max | Min |
| Embodiment 1 | 0.94 | 0.64 | 0.944 | 0.615 | 0.957 | 0.57 |
| Embodiment 2 | 0.949 | 0.78 | 0.947 | 0.756 | 0.95 | 0.71 |

*Greater twist pitch values form denominators.

In both Embodiments 1 and 2 shown in Tables 6 and 7, as seen from Table 8, the twist pitches of all the insulated wire pairs 14 are selected from the region which fulfills expressions (1) and (2) or expressions (1) and (3), or from the region which additionally fulfills expression (4) in the case where they are in compliance with the prior conditions of expression (4).

According to the present invention, therefore, it is indicated that a satisfactory crosstalk characteristic can be obtained by selecting the twist pitches of the insulated wire pairs 14 from the region which fulfills expressions (1) and (2) or expressions (1) and (3), or from the region which additionally fulfills expression (4) in the case where they meet the prior conditions of expression (4).

Thus, the communication cables 10 can ensure high-speed data communication with a satisfactory insulated wire pairs 14 are suitably selected from the region which fulfills expressions (1) and (2) or expressions (1) and (3), or from the region which additionally fulfills expression (4) in the case where they meet the prior conditions of expression (4). In this case, the satisfactory crosstalk characteristic can be enjoyed without specially jacketing each unit 12, so that the communication cables 10 can meet the standard specifications of the ISO/IEC, securing reduced diameter, lighter weight, and flexibility.

What is claimed is:

1. A communication cable comprising:

a plurality of units cabled in a manner such that each two adjacent units have different twist pitches, each of said units including a plurality of insulated wire pairs twisted together so that each two adjacent insulated wire pairs have different twist pitches;

a twist pitch $P_i$ of an insulated wire pair $T_i$ optionally selected among said plurality of insulated wire pairs which constitute a unit $U_i$, out of two adjacent units $U_i$ and $U_j$ optionally selected among said plurality of units, and a twist pitch $P_j$ of an insulated wire pair $T_i$ optionally selected among said plurality of insulated wire pairs which constitute said unit $U_i$ are different;

said twist pitches $P_i$ and $P_j$ are both selected from a region which fulfills one of:

(a) the following expressions (1) and (2) and (b) the following expressions (1) and (3); and said twist pitch $P_i$ and a twist pitch $P_k$ of an insulated wire pair $T_k$ optionally selected among said plurality of insulated wire pairs which constitute a unit $U_k$, out of two optionally selected alternate units $U_i$ and $U_k$, are both selected from a region which fulfills the following expression (4) in the case where said twist pitches $P_i$ and $P_k$ are in compliance with prior conditions given by said expression (4):

$$P_{ix} \times P_{jx}/d^2 \leqq 7 \quad \ldots (1)$$

one of:

$$(i)\ P_{iy}/P_{jy} \geqq 1.25\ (P_{iy} > P_{jy}),\ \text{and}\ (ii)\ P_{iy}/P_{jy} \leqq 0.8\ (P_{iy} < P_{jy}), \quad \ldots (2)$$

in the case where $144 < P_{iy} \times P_{jy}/d^2 \leqq 413$; one of:

$$(iii)\ P_{iy}/P_{jy} \geqq 1.09\ (P_{iy} > P_{jy}),\ \text{and}\ (iv)\ P_{iy}/P_{jy} \leqq 0.92\ (P_{iy} < P_{jy}) \ldots (3)$$

in the case where $P_{iy} \times P_{jy}/d^2 \leqq 144$; and one of:

$$(v)\ P_{iy}/P_{ky} \geqq 1.04\ (P_{iy} > P_{ky}),\ \text{and}\ (vi)\ P_{iy}/P_{ky} \leqq 0.96\ (P_{iy} < P_{ky}) \ldots (4)$$

in the case where $P_{iy}/d > 16.4$ and $P_{ky}/d > 16.4$ are given as prior conditions, where $P_{ix}$ and $P_{ix}$ are unit diametrical components of the twist pitch $P_i$ of said insulated wire pair $T_i$ and the twist pitch $P_j$ of said insulated wire pair $T_j$, respectively, $P_{iy}$, $P_{iy}$ and $P_{ky}$ are unit lengthwise components of the twist pitch $P_i$ of said insulated wire pair $T_i$, the twist pitch $P_j$ of said insulated wire pair $T_i$, and the twist pitch $P_k$ of said insulated wire pair $T_k$, respectively, and d is the outside diameter of insulated wires which constitute said plurality of insulated wire pairs.

2. A communication cable according to claim 1, wherein said twist pitches of said insulated wire pairs fulfill the following conditions (a) to (d):

(a) the twist pitch $P_i$ of the insulated wire pair $T_i$ optionally selected among the insulated wire pairs which constitute said unit $U_i$ is selected from a region given by $P_{iy}/d \leqq 16.4$;

(b) a twist pitch $P_{ja}$ of one insulated wire pair $T_{ja}$ among said plurality of insulated wire pairs which constitute said unit $U_j$ adjacent to the unit $U_i$ which fulfills said condition (a), with respect to the twist pitches $P_j$ of the insulated wire pairs which constitute the unit $U_j$, is set so as to be smaller than a minimum value $P_{i(min)}$ of the twist pitch $P_i$ ($P_{i(min)}>P_{ja}$), and the relation between said twist pitch $P_{ja}$ and the minimum value $P_{i(min)}$ of said twist pitch $P_i$ fulfills $P_{i(min)y}/P_{jay} \geqq 1.09$ of said expression (3), twist pitches $P_{jR}$ of the insulated wire pairs other than said one insulated wire pair $T_{ja}$, among the insulated wire pairs which constitute said unit $U_j$, being given by $P_i<P_{jR}$, and the relation between said twist pitches $P_{jR}$ and $P_i$ being set so as to fulfill $P_{iy}/P_{iRy}<0.8$ of said expression (2);

(c) each of units $U_{i1}$ to $U_{in}$ arranged alternately following the unit $U_i$ which fulfills said condition (a) is comprised of said plurality of insulated wire pairs having the same twist pitches as the insulated wire pairs which constitute said unit $U_i$;

(d) a minimum value $P_{j1(min)}$ of twist pitches $P_{j1}$ of said plurality of insulated wire pairs which constitute a unit $U_{j1}$ displaced from the unit $U_j$ by one unit is set so as to be equal to said twist pitch $P_{ja}$ of a minimum value $P_{j(min)}$ of said twist pitch $P_j$ ($P_{j(min)}=P_{j1(min)}$), and $P_{jRy}/P_{j1Ry} \geqq 1.04$ is fulfilled when the relation between twist pitches $P_{j1R}$ other than the minimum value $P_{j1(min)}$ of the twist pitches $P_{j1}$ of the insulated wire pairs which constitute said unit $U_{j1}$ and twist pitches other than said twist pitch $P_{ja}$ of the minimum value $P_{j(min)}$ of the twist pitch $P_j$ of the insulated wire pairs which constitute the unit $U_j$ which fulfills said condition. (b) is given by $P_{jRy}>P_{j1Ry}$, and $P_{jRy}/R_{j1Ry} \leqq 0.96$ is fulfilled when said relation is given by $P_{jRy}<P_{j1Ry}$, the relation between the twist pitches of said plurality of insulated wire pairs which constitute one unit and the twist pitches of said plurality of insulated wire pairs which constitute the other unit, out of two alternate units optionally selected among units $U_{j1}$ to $U_{in}$ arranged alternately following the unit $U_j$ which fulfills said condition (b), being set so as to fulfill said condition (d).

3. A communication cable according to claim 1, wherein said twist pitches of said insulated wire pairs fulfill the following additional conditions (e) to (h):

(e) the twist pitch $P_i$ of the insulated wire pair $T_i$ optionally selected among the insulated wire pairs which constitute said unit $U_i$ is selected from a region given by $P_{iy}/d \leqq 16.4$;

(f) twist pitches $P_{ja}$ and $P_{jb}$ of two insulated wire pairs $T_{ja}$ and $T_{jb}$ among a plurality of insulated wire pairs which constitute said unit $U_j$ adjacent to the unit $U_i$ which fulfills said condition (e), with respect to the twist pitch $P_j$ of the insulated wire pairs which constitute the unit $U_j$, are set so as to be smaller than a minimum value $P_{i(min)}$ of the twist pitch $P_i$ ($P_{imin)}>P_{ja}$, $P_{i(min)}>P_{jb}$), and the relation between said twist pitch $P_{ja}$ and the minimum value $P_{i(min)}$ of said twist pitch $P_i$ and the relation between said twist pitch $P_{jb}$ and the minimum value $P_{i(min)}$ fulfill $P_{i(min)y}/P_{jay} \geqq 1.09$ and $P_{i(min)y}/P_{jby} \geqq 1.09$ of said expression (3), respectively, twist pitches $P_{jR}$ of the insulated wire pairs other than said two insulated wire pairs $T_{ja}$ and $T_{jb}$, among the insulated wire pairs which constitute said unit $U_j$, being given by $P_i<P_{jR}$, and the relation between said twist pitches $P_{jR}$ and said twist pitch $P_i$ being set so as to fulfill $P_{iy}/P_{iRy}<0.8$ of said expression (2);

(g) each of units $U_{i1}$ to $U_{in}$ arranged alternately following the unit $U_i$ which fulfills said condition (e) is comprised of a plurality of insulated wire pairs having the same twist pitches as the insulated wire pairs which constitute said unit $U_i$;

(h) twist pitches $P_{j1a}$ and $P_{j1b}$ of two insulated wire pairs $T_{j1a}$ and $T_{j1b}$, out of a plurality of insulated wire pairs which constitute a unit $U_{j1}$ displaced from the unit $U_j$ by one unit are set so as to be equal to said twist pitches $P_{ja}$ and $P_{jb}$ ($P_{ja}=P_{j1a}$, $P_{jb}=P_{j1b}$), respectively, of said two insulated wire pairs $T_{ja}$ and $T_{jb}$ which are smaller than the minimum value $P_{i(min)}$ of said twist pitch $P_i$ of the insulated wire pairs which constitute the unit $U_i$ which fulfills said condition (e), and $P_{jRy}/P_{j1Ry} \geqq 1.04$ fulfills said expression (4) when the relation between twist pitches $P_{j1R}$ other than said twist pitches $P_{j1a}$ and $P_{j1b}$, out Of the twist pitches $P_{j1}$ of the insulated wire pairs which constitute said unit $U_{j1}$, and twist pitches $P_{jR}$ other than said twist pitches $P_{ja}$ and $P_{jb}$, out of the twist pitches $P_j$ of the insulated wire pairs which constitute the unit $U_j$ which fulfills said condition (f), is given by $P_{jRy}>P_{j1Ry}$, and $P_{jRy}/P_{1Ry} \leqq 0.96$ is fulfilled when said relation is given by $P_{jRy}<P_{j1Ry}$, the relation between the twist pitches of a plurality of insulated wire pairs which constitute one unit and the twist pitches of a plurality of insulated wire pairs which constitute the other unit, out of two alternate units optionally selected among units $U_{j1}$ to $U_{jn}$ arranged alternately following the unit $U_j$ which fulfills said condition (f), being set so as to fulfill said condition (h).

4. A communication cable according to claim 1, further comprising a binding tape which integrally coats each of said units.

5. A communication cable according to claim 4, further comprising a jacket which coats over said binding tape.

6. a communication cable according to claim 1, further comprising a binding tape which integrally coats over said plurality of units.

7. A communication cable according to claim 6, further comprising a jacket which coats over said binding tape of said plurality of units.

8. A communication cable according to claim 6, further comprising a further binding tape which integrally coats each of said units.

* * * * *